US010815669B2

(12) United States Patent
Diercks et al.

(10) Patent No.: US 10,815,669 B2
(45) Date of Patent: Oct. 27, 2020

(54) MULTIFUNCTION STRUCTURAL FURRING SYSTEM

(71) Applicant: James Hardie Technology Limited, Dublin (IE)

(72) Inventors: Chad Diercks, Yucaipa, CA (US); Benjamin Batres, Fontana, CA (US); Michael McEndree, Akron, OH (US); David Shaw, Seattle, WA (US); Jose Gonzalez, Corona, CA (US)

(73) Assignee: James Hardie Technology Limited, Dublin (IE)

( * ) Notice: Subject to any disclaimer, the term of this patent is extended or adjusted under 35 U.S.C. 154(b) by 0 days.

(21) Appl. No.: 15/940,715

(22) Filed: Mar. 29, 2018

(65) Prior Publication Data

US 2018/0283013 A1 Oct. 4, 2018

Related U.S. Application Data

(60) Provisional application No. 62/478,980, filed on Mar. 30, 2017.

(51) Int. Cl.
*E04F 13/08* (2006.01)
*E04B 1/26* (2006.01)
(Continued)

(52) U.S. Cl.
CPC ..... *E04F 13/0805* (2013.01); *E04B 1/26* (2013.01); *E04B 1/7069* (2013.01);
(Continued)

(58) Field of Classification Search
CPC .... E04F 13/0805; E04F 13/0803; E04F 19/06
(Continued)

(56) References Cited

U.S. PATENT DOCUMENTS 1,545,168 A * 7/1925 Schenck ..... B21D 47/04
52/842
2,664,179 A * 12/1953 Gwynne ..... E04C 3/06
403/387

(Continued)

FOREIGN PATENT DOCUMENTS

DE 2518629 A1 * 10/1976 ..... E04F 13/0803
EP 2312086 A2 * 4/2011 ..... E04C 3/06

(Continued)

OTHER PUBLICATIONS

International Search Report and Written Opinion for corresponding PCT Application No. EP2018/058267, dated Apr. 9, 2018, in 19 pages.

(Continued)

*Primary Examiner* — Patrick J Maestri
*Assistant Examiner* — Joseph J. Sadlon
(74) *Attorney, Agent, or Firm* — Knobbe Martens Olson & Bear, LLP

(57) ABSTRACT

Structural furring systems having enhanced drainage functionality are described. Furring strips can include a substantially planar face, substantially planar webs extending from edges of the face, and substantially planar legs extending from opposite edges of the legs. The face and/or legs include a row or array of protrusions configured to accommodate drainage and ventilation between the furring strip and an attached exterior cladding and/or building substrate. Furring strips can be manufactured by rolling a sheet metal such as steel. Additional embodiments include a furring tape configured to be affixed to a substantially flat face of a commercially available furring strip to provide similar drainage features.

20 Claims, 17 Drawing Sheets

(51) Int. Cl.

| | |
|---|---|
| ***E04B 1/70*** | (2006.01) |
| ***E04F 13/00*** | (2006.01) |
| ***E04F 19/06*** | (2006.01) |
| *E04F 17/10* | (2006.01) |

(52) U.S. Cl.
CPC ..... *E04F 13/007* (2013.01); *E04F 13/0803* (2013.01); *E04F 13/0887* (2013.01); *E04F 19/06* (2013.01); *E04F 17/10* (2013.01)

(58) Field of Classification Search
USPC ..... 52/506.05
See application file for complete search history.

(56) References Cited

U.S. PATENT DOCUMENTS 2,853,870 A * 9/1958 Sinner ..... E04H 13/006 52/378
3,129,792 A * 4/1964 Gwynne ..... E04B 2/60 52/364
3,196,763 A * 7/1965 Rushton ..... E04C 2/32 404/19
3,318,056 A * 5/1967 Thompson ..... E04B 2/709 52/105
3,333,379 A * 8/1967 Harris ..... E04F 13/0803 52/346
3,381,439 A * 5/1968 Thulin, Jr. ..... E04C 3/09 52/842
3,477,187 A * 11/1969 Fruman ..... E04F 13/0803 52/346
3,594,969 A * 7/1971 Kantorowicz ..... A47G 27/0475 52/392
3,807,101 A * 4/1974 Cole ..... E04B 1/26 52/11
3,832,813 A * 9/1974 Hindman ..... E04B 1/34342 52/169.12
3,849,961 A * 11/1974 Gwynne ..... E04C 3/09 52/639
3,888,087 A * 6/1975 Bergsland ..... E02D 31/02 405/36
3,962,066 A * 6/1976 Barber ..... C25B 9/00 204/279
4,016,700 A * 4/1977 Blomstedt ..... E04B 2/7412 52/481.1
4,092,810 A * 6/1978 Sumner ..... E04B 1/3211 52/745.08
4,245,443 A * 1/1981 Beechen ..... E04B 1/7023 52/169.5
4,263,752 A * 4/1981 Jungbluth ..... E06B 5/16 49/501
4,295,637 A * 10/1981 Hulek ..... E01F 8/0041 256/13.1
4,534,142 A * 8/1985 Drefahl ..... A01G 20/20 52/90.2
4,545,291 A * 10/1985 Kutsch ..... A01K 1/0058 454/365
4,578,915 A * 4/1986 Schneller ..... B32B 13/12 52/309.12
4,691,494 A * 9/1987 Gwynne ..... E04C 3/07 52/842
5,094,051 A * 3/1992 Miller ..... E04F 13/0812 52/235
5,217,319 A * 6/1993 Klohn ..... A61H 3/066 340/407.1
5,285,615 A * 2/1994 Gilmour ..... E04B 2/7412 52/781
5,326,609 A * 7/1994 Gohlke ..... B32B 15/04 428/76
5,399,406 A * 3/1995 Matsuo ..... B32B 3/12 428/57
5,570,555 A * 11/1996 Ferguson ..... E04B 7/02 52/535
5,592,796 A * 1/1997 Landers ..... E04B 2/7457 52/241
5,619,832 A * 4/1997 Myrvold ..... E02D 31/02 428/116
5,628,154 A * 5/1997 Gavette ..... E04B 1/3211 52/81.4
5,687,538 A * 11/1997 Frobosilo ..... E04B 5/10 52/100
5,689,990 A * 11/1997 Deeley ..... B21D 13/04 52/630
5,778,626 A * 7/1998 Hellsten ..... E04C 3/07 29/6.1
5,820,296 A * 10/1998 Goughnour ..... E02B 11/005 405/43
5,826,390 A * 10/1998 Sacks ..... E04B 1/62 52/408
5,918,998 A * 7/1999 Pourmand ..... A47B 47/005 403/169
6,092,349 A * 7/2000 Trenerry ..... E04C 3/07 52/846
6,112,476 A * 9/2000 Schulenburg ..... E04B 1/70 52/169.5
6,298,620 B1 * 10/2001 Hatzinikolas ..... E04B 1/70 52/302.1
6,450,728 B1 * 9/2002 Grahmbeek ..... E01F 9/50 404/15
6,688,060 B2 * 2/2004 Sawada ..... E04B 1/6809 403/265
6,698,710 B1 * 3/2004 VanderWerf ..... E02D 27/02 249/159
6,868,639 B1 * 3/2005 Gunthardt ..... E04H 9/14 52/79.4
6,939,599 B2 * 9/2005 Clark ..... B32B 3/30 428/178
6,987,928 B2 * 1/2006 Shields ..... E01C 11/26 165/45
7,137,224 B2 * 11/2006 Rasmussen ..... E04D 13/152 52/96
7,191,570 B1 * 3/2007 Eaton ..... E04B 9/22 52/465
7,621,079 B2 * 11/2009 Takagi ..... E04B 1/70 52/100
7,681,362 B1 * 3/2010 Averitt ..... E04B 1/34342 454/185
7,690,862 B2 * 4/2010 Szekely ..... A47G 27/0293
7,698,858 B2 * 4/2010 Schroer ..... E04H 9/145 52/169.5
7,712,273 B2 * 5/2010 Panasik ..... E04D 3/361 52/459
D618,365 S * 6/2010 Crane ..... D25/121
7,743,578 B2 * 6/2010 Edmondson ..... C08L 67/02 52/633
8,028,557 B2 * 10/2011 Voth ..... B21D 13/045 72/177
8,056,252 B2 * 11/2011 Fernandes ..... E04C 2/384 52/481.1
8,109,124 B2 * 2/2012 Lin ..... B21C 47/28 242/137.1
8,307,610 B2 * 11/2012 Landers ..... E04C 3/07 52/144
8,387,336 B2 * 3/2013 Coulton ..... E04B 1/625 52/741.4
8,438,803 B2 * 5/2013 Turner ..... E04B 2/7457 52/220.8
8,484,931 B2 * 7/2013 Gleeson ..... E04H 9/14 52/79.4
8,522,509 B2 * 9/2013 Tracy ..... E04F 13/086
8,528,278 B2 * 9/2013 Sippola ..... A61H 3/066 52/177
8,590,217 B2 * 11/2013 Gleeson ..... E04B 2/707 52/105
8,683,774 B2 * 4/2014 Strickland ..... E04C 3/07 29/897.312
8,938,926 B2 * 1/2015 Sareyka ..... E04B 2/7453 52/235

(56) References Cited

U.S. PATENT DOCUMENTS 8,973,329 B2 * 3/2015 Milostic ..... E04B 1/70 52/411
9,045,898 B2 * 6/2015 Ravnaas ..... E04B 1/82
9,091,050 B2 * 7/2015 Boyd ..... E04B 9/068
9,163,413 B2 * 10/2015 Brady ..... E04B 9/068
D751,733 S * 3/2016 Darr, III ..... B21D 13/045 72/177
9,458,624 B2 * 10/2016 Colyn ..... E04B 1/38
9,499,974 B2 * 11/2016 Bombino ..... E04B 1/7612
D782,709 S * 3/2017 Quintile ..... D25/164
9,788,674 B2 * 10/2017 Pacione ..... E04C 3/09 52/639
9,856,642 B2 * 1/2018 Ukrainetz ..... E04F 13/0803
10,081,951 B2 * 9/2018 Omori ..... E04B 2/7412 52/781
10,174,503 B2 * 1/2019 Grant ..... B32B 5/245
10,519,673 B2 * 12/2019 Joshi ..... E04C 3/06 403/387
10,724,232 B2 * 7/2020 Glavin ..... E04B 7/20
2002/0056243 A1 5/2002 Sawada
2003/0014935 A1 * 1/2003 Bodnar ..... E04C 2/384 52/481.1
2004/0200177 A1 * 10/2004 Okumura ..... C08L 67/02 52/633
2005/0279574 A1 * 12/2005 Halterbeck ..... B32B 3/26 181/293
2008/0120932 A1 * 5/2008 Paradis ..... E04C 2/243 52/309.8
2008/0163582 A1 * 7/2008 Trevethick ..... E04B 1/70 52/716.2
2009/0090070 A1 * 4/2009 Finch ..... E04B 1/3205 52/94
2009/0193738 A1 * 8/2009 Kortuem ..... E02D 31/02 52/302.1
2009/0249743 A1 * 10/2009 Bodnar ..... E04C 3/09 52/846
2010/0146893 A1 * 6/2010 Dickinson ..... E04B 1/70 52/302.3
2013/0291465 A1 * 11/2013 Resso ..... E04F 13/007 52/302.1
2014/0147611 A1 * 5/2014 Ackerman, Jr. ..... E04D 13/15 428/41.8
2017/0144210 A1 * 5/2017 Anderson ..... E04C 3/09
2018/0339259 A1 * 11/2018 Hallberg ..... E04C 3/07 52/842
2019/0100910 A1 * 4/2019 Glavin ..... E04C 3/07 52/144

FOREIGN PATENT DOCUMENTS

GB 124709 A * 6/1919 ..... E04C 3/06
GB 373699 A * 6/1932 ..... E04F 13/0803
WO WO-9734059 A1 * 9/1997 ..... E04F 13/0803
WO WO 00/63506 10/2000
WO WO-2007134436 A1 * 11/2007 ..... E04F 13/0803

OTHER PUBLICATIONS

Invitation to Pay Additional Fees and, Where Applicable, Protest fee, for corresponding PCT Application No. PCT/EP2018/058267, filed Mar. 29, 2018, dated Jun. 20, 2018, in 13 pages.

* cited by examiner

MULTIFUNCTION STRUCTURAL FURRING SYSTEM

CROSS-REFERENCE TO RELATED APPLICATIONS

This application claims the benefit of priority under 35 U.S.C. § 119(e) of U.S. Provisional Application Ser. No. 62/478,980, filed Mar. 30, 2017, entitled "MULTIFUNCTION STRUCTURAL FURRING SYSTEM," which is hereby incorporated by reference herein in its entirety.

BACKGROUND

Field

The present disclosure generally relates to building construction materials and methods, and more particularly relates to cladding systems including furring.

Description of the Related Art

Cladding panels such as those made of fiber cement are frequently attached to the structural frame of a building to form a non-structural facade of the building. Furring strips are often disposed between the cladding panels and the building structure to form an air gap therebetween. The air gap creates a capillary break which allows for drainage and evaporation of moisture.

Conventional furring strips can present a number of disadvantages. They typically must be installed in a vertical orientation so as to provide adequate drainage, as horizontally oriented furring strips can limit the drainage and drying capacity of a wall cavity behind a cladding. Lateral spacing and alignment of vertically oriented furring is generally relatively inflexible, being determined by the location and spacing of studs or other vertically oriented building substrate materials. In addition, the wind load rating on cladding panels fastened to conventional furring strips may be less than desirable. Nail withdrawal or pull through are common causes of cladding system failure.

SUMMARY

The systems, methods, and devices described herein address one or more problems as described above and associated with current furring systems. The systems, methods and devices described herein have innovative aspects, no single one of which is indispensable or solely responsible for their desirable attributes. Without limiting the scope of the claims, the summary below describes some of the advantageous features.

In one embodiment, a wall cladding system having a multifunction structural furring is described. The wall cladding system comprises a furring strip made of a rolled sheet metal, and at least one wall cladding panel. The furring strip comprises a substantially planar face defined generally by a length and a width, the face comprising a first edge and a second edge opposite the first edge along the width, the face comprising an array of convex dimples extending from an outer side of the face; a plurality of substantially planar webs, each web extending from the first edge or the second edge of the face in a direction opposite the outer side, each web comprising a plurality of openings extending through the web to accommodate water or air flow through the web; and a plurality of substantially planar legs parallel to the face, each leg extending from one of the plurality of webs at an end opposite the face, each leg comprising a row of convex dimples extending from an inner side of the leg opposite the webs and face, wherein the furring strip is mounted to the exterior of a building substrate by a plurality of mechanical fasteners such that the convex dimples of the legs abut the building substrate and the length of the face is in a horizontal orientation relative to the building substrate. The at least one wall cladding panel is mounted to the furring strip by one or more mechanical fasteners such that the convex dimples of the face abut the wall cladding panel. An inner surface of the wall cladding panel, the outer side of the face, and two or more of the dimples of the face define a first gravity-assisted drainage flow path. The building substrate, the inner sides of the legs, and two or more of the dimples of the legs define a second gravity-assisted drainage flow path.

In some embodiments, the rolled sheet metal comprises steel having a thickness of at least 20 gauge and not greater than 16 gauge. In some embodiments, the dimples are arranged in a rectangular array on the face with a spacing of at least 0.25 inches and not greater than approximately 1 inch between adjacent dimples. In some embodiments, the dimples extend to a height of between 0.03125 inches and approximately 0.25 inches relative to the outer side of the face. In some embodiments, the dimples extend to a height of between approximately 0.0625 inches and approximately 0.125 inches relative to the outer side of the face. In some embodiments, a wind load producing a force of 44.4 lbf at two or more adjacent mechanical fasteners mounting the wall cladding panel to the furring strip induces a deflection in the face between 0 and l/240 inches, where l is the span distance, expressed in inches, between the two adjacent mechanical fasteners.

In another embodiment, a furring strip for mounting a wall cladding article to a building substrate is described. The furring strip comprises a substantially planar face defined generally by a length and a width, the face comprising a first edge and a second edge opposite the first edge along the width, a plurality of substantially planar webs, each web extending from the first edge or the second edge of the face, and a plurality of substantially planar legs parallel to the face, each leg extending from one of the plurality of webs at an end opposite the face. The face comprises a plurality of protrusions configured to produce one or more drainage channels between the face and a cladding article secured to the face, said drainage channels defining at least one gravity-assisted fluid flow path when the furring strip is mounted in a horizontal or vertical orientation.

In some embodiments, each of the plurality of legs comprises a plurality of protrusions configured to produce one or more drainage channels between the legs and a building substrate secured to the legs. In some embodiments, the protrusions comprise an array of dimples extending from an outer side of the face. In some embodiments, the dimples are arranged in a rectangular array on the face with a spacing of at least 0.25 inches and not greater than approximately 1 inch between adjacent dimples. In some embodiments, the dimples extend to a height of between approximately 0.03125 inches and approximately 0.25 inches relative to the outer side of the face. In some embodiments, the dimples extend to a height of between approximately 0.0625 inches and approximately 0.125 inches relative to the outer side of the face. In some embodiments, each of the webs comprises a plurality of openings extending through the web to accommodate water or air flow through the web. In some embodiments, each of the openings has a width between approximately 0.1 inches and approximately 0.3 inches, and a length between approximately 0.5 inches and 1.5 inches.

In some embodiments, the furring strip comprises a rolled sheet metal. In some embodiments, the metal comprises steel having a thickness of at least 20 gauge and not greater than 16 gauge. In some embodiments, a wind load of approximately 44.4 lbf at two or more fastening points along the face produces a deflection between 0 and l/240 inches, where l is the span distance, expressed in inches, between the fastening points.

In another embodiment, an adhesive drainage tape for a furring strip is described. The adhesive tape comprises a substantially planar tape defined generally by a length, a width, an inner surface, and an outer surface, the inner surface at least partially coated with a chemical adhesive, and an array of protrusions extending from the outer surface, the protrusions generally defined by a height relative to the outer surface and a spacing between adjacent protrusions. The adhesive tape is configured to be fixed by the chemical adhesive to a substantially flat face surface of a structural furring strip before an exterior cladding article is coupled to the furring strip such that, when the exterior cladding article is coupled to the furring strip, a gravity-assisted drainage flow path is defined by an inner surface of the wall cladding panel, the outer surface of the tape, and two or more of the protrusions.

In some embodiments, the protrusions are arranged in a rectangular array on the outer surface with a spacing of at least 0.25 inches and not greater than approximately 1 inch between adjacent protrusions. In some embodiments, the protrusions extend to a height of between approximately 0.03125 inches and approximately 0.25 inches relative to the outer surface. In some embodiments, the protrusions extend to a height of between approximately 0.0625 inches and approximately 0.125 inches relative to the outer surface. In some embodiments, the protrusions comprise dimples having a circular cross-section. In some embodiments, the width of the adhesive tape is selected to fit against a face of a hat channel furring strip.

BRIEF DESCRIPTION OF THE DRAWINGS

Certain embodiments of the present disclosure will now be described, by way of example only, with reference to the accompanying drawings. From figure to figure, the same or similar reference numerals are used to designate similar components of an illustrated embodiment.

DETAILED DESCRIPTION

Figures 1A, 1B:
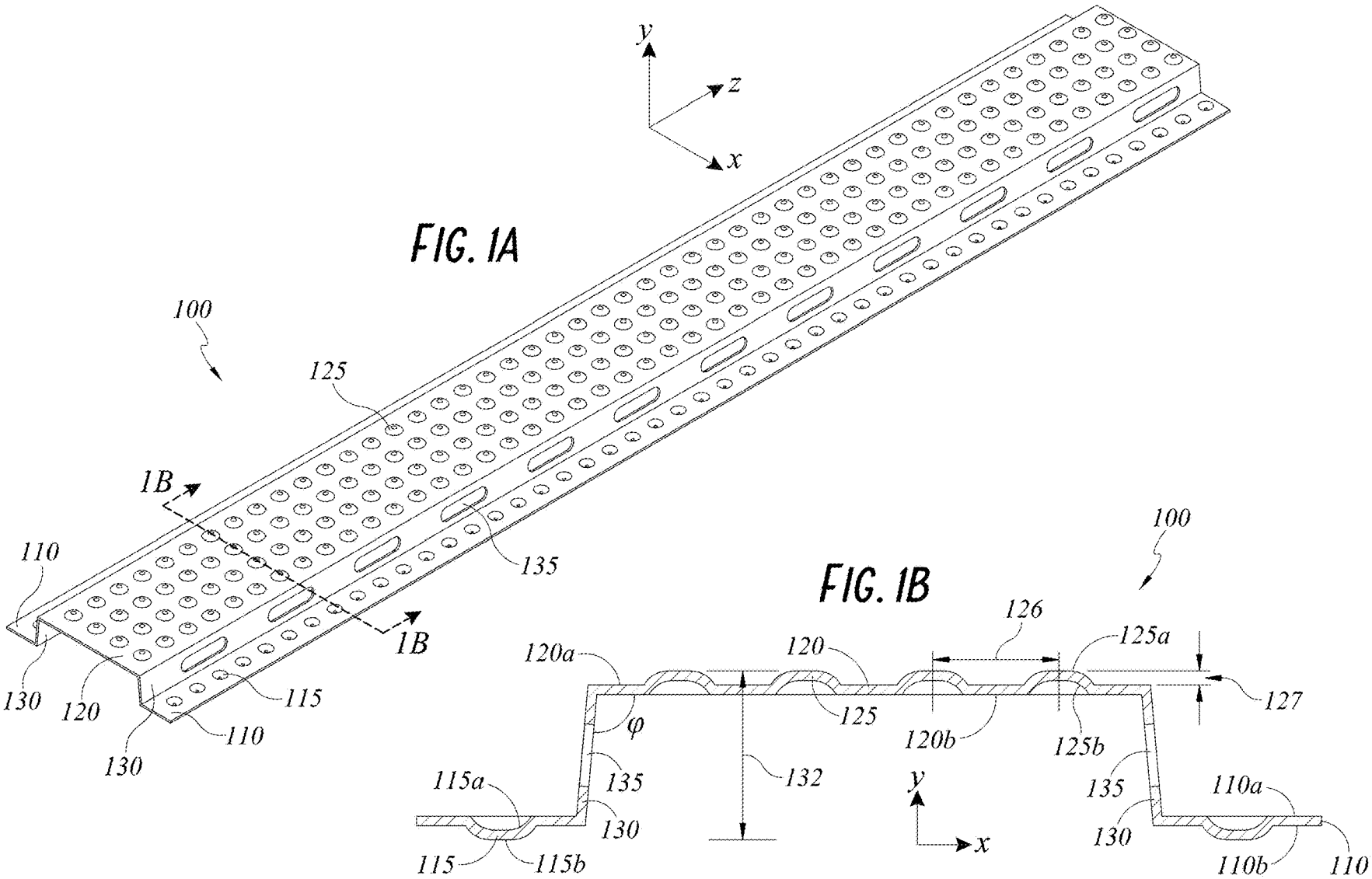
FIG. 1A is a perspective view of a furring strip with drainage features in accordance with a first example embodiment.
FIG. 1B is a cross-sectional profile view taken about the line 1B-1B of FIG. 1A, illustrating an example configuration of drainage features incorporated therein.
Figure 1C:
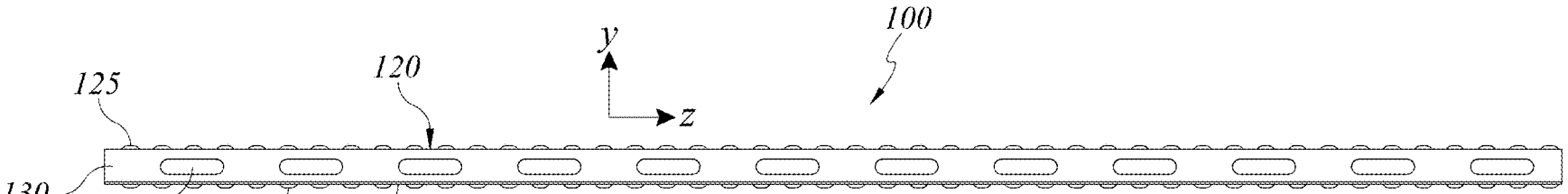
FIG. 1C is a side elevation view of the furring strip of FIGS. 1A and 1B.
Figure 1D:
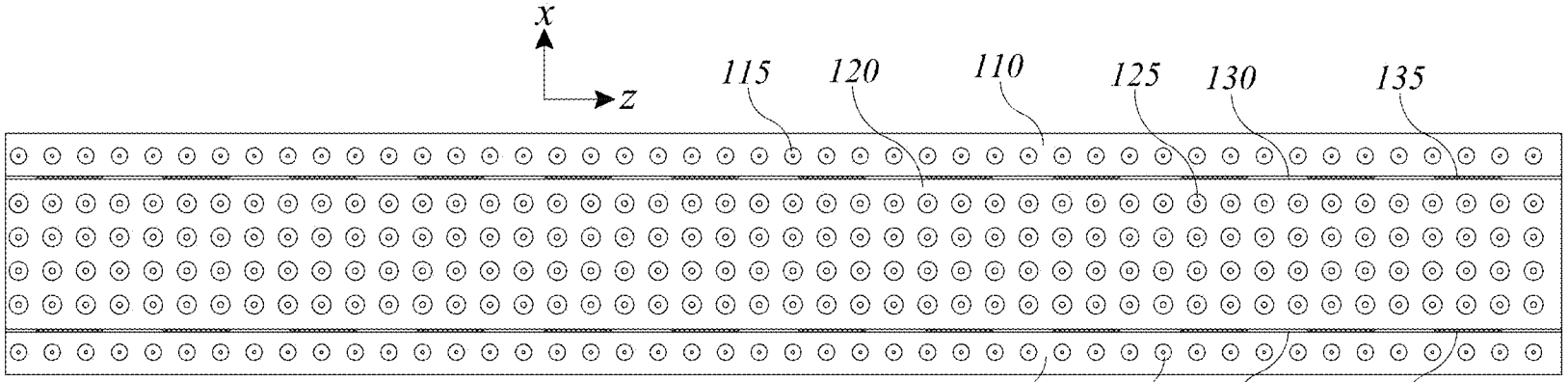
FIG. 1D is a top plan view of the furring strip of FIGS. 1A-1C.
Figure 2A:
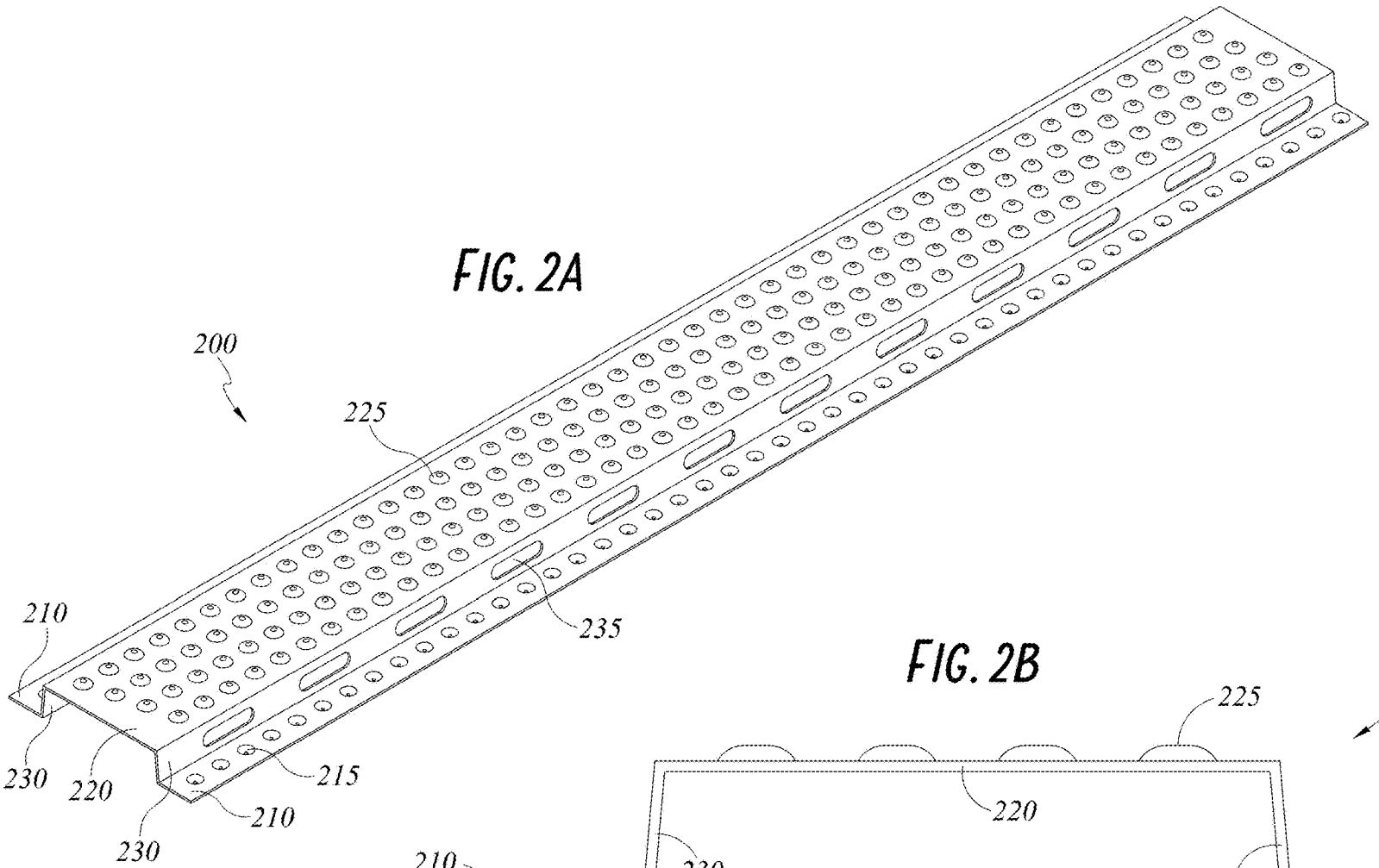
FIG. 2A is a perspective view of a furring strip with drainage features in accordance with a second example embodiment.
Figure 2B:
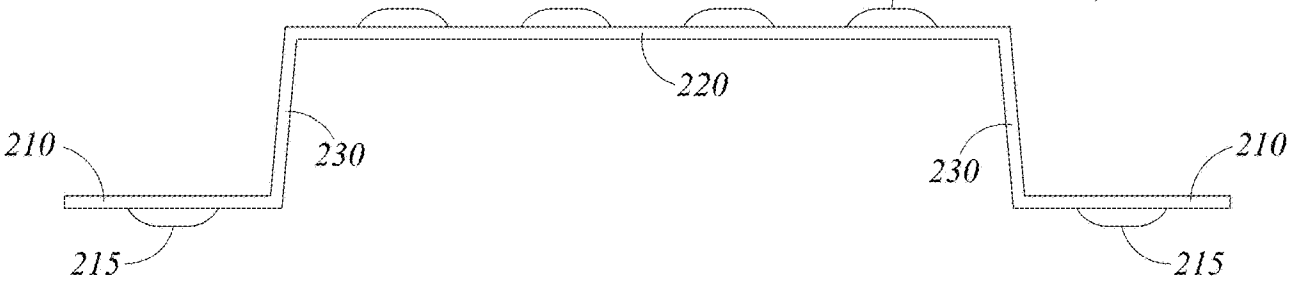
FIG. 2B is an end profile view of the furring strip of FIG. 2A, illustrating an example configuration of drainage features incorporated therein.
Figure 2C:
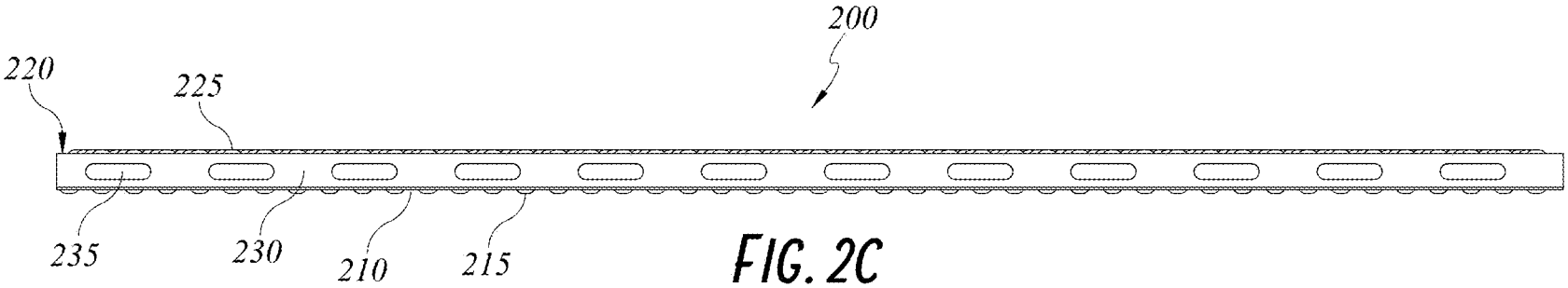
FIG. 2C is a side elevation view of the furring strip of FIGS. 2A and 2B.
Figure 2D:
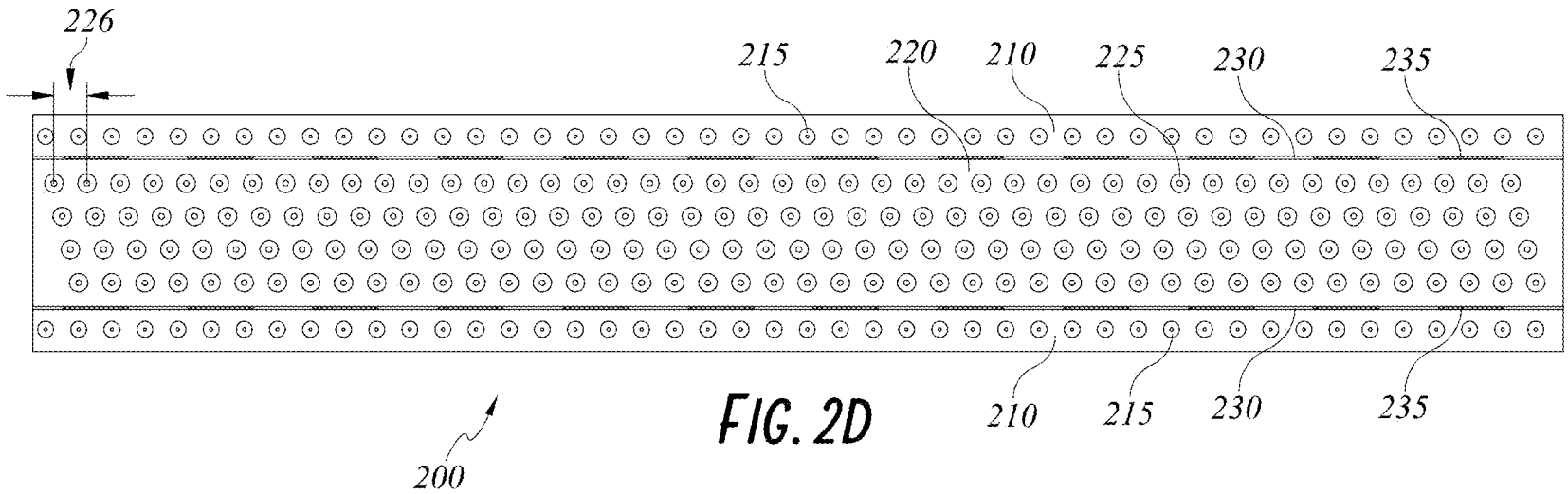
FIG. 2D is a top plan view of the furring strip of FIGS. 2A-2C.
Figure 3A:
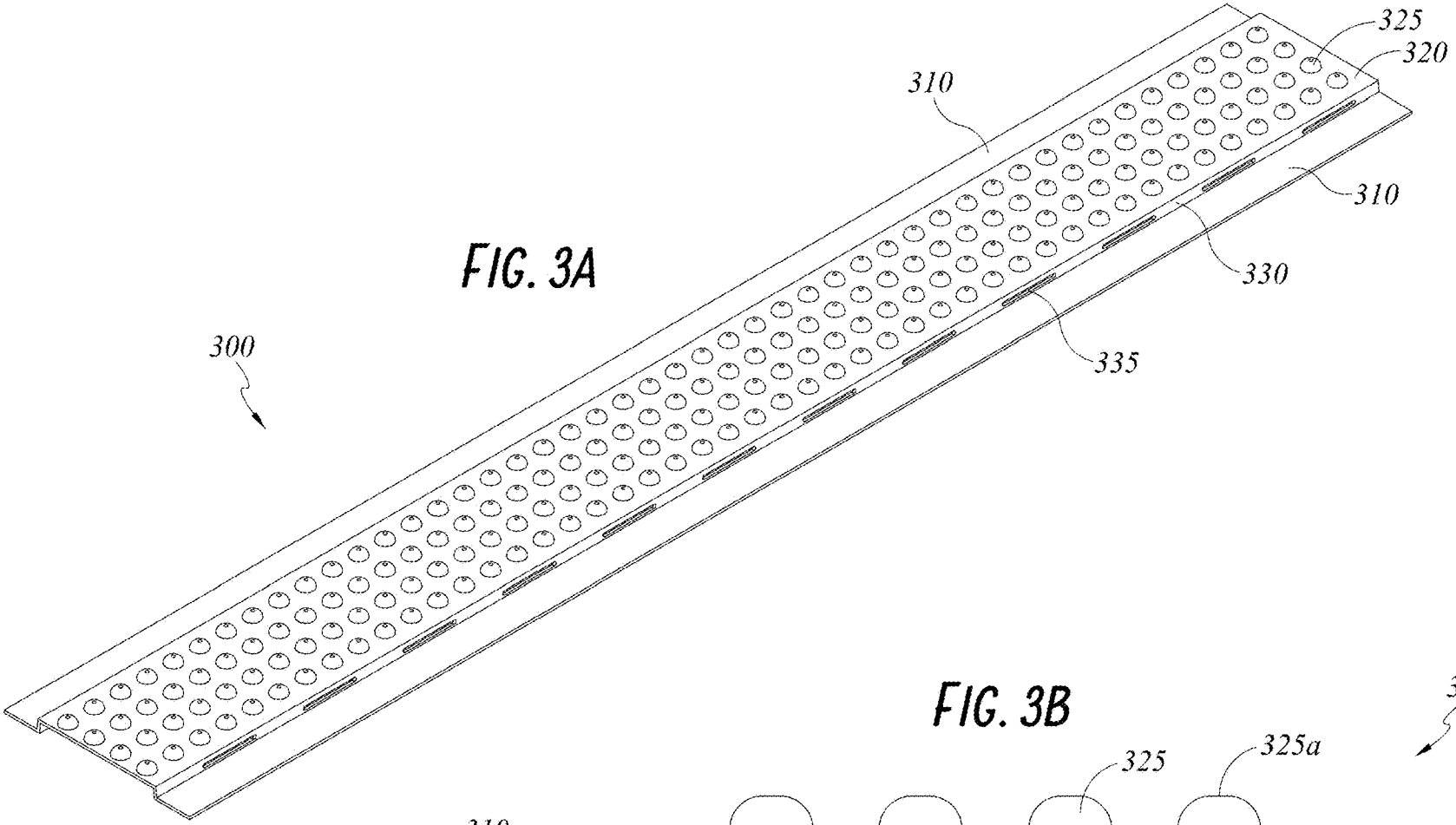
FIG. 3A is a perspective view of a furring strip with drainage features in accordance with a third example embodiment.
Figure 3B:
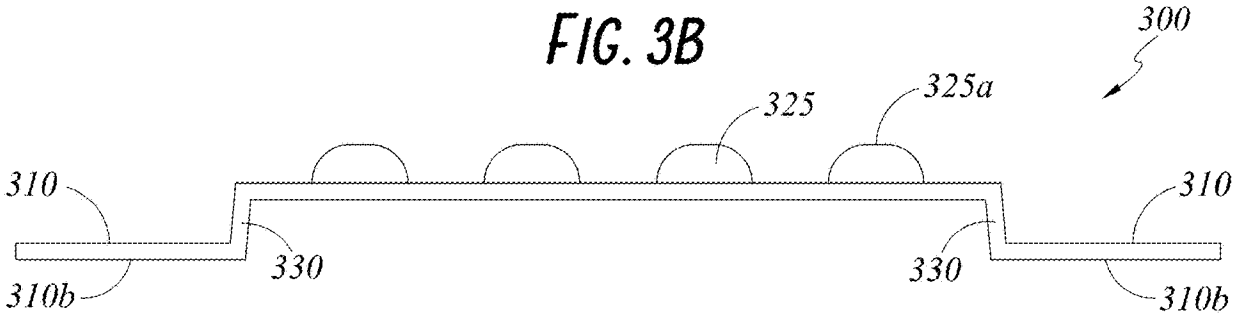
FIG. 3B is an end profile view of the furring strip of FIG. 3A, illustrating an example configuration of drainage features incorporated therein.
Figure 3C:
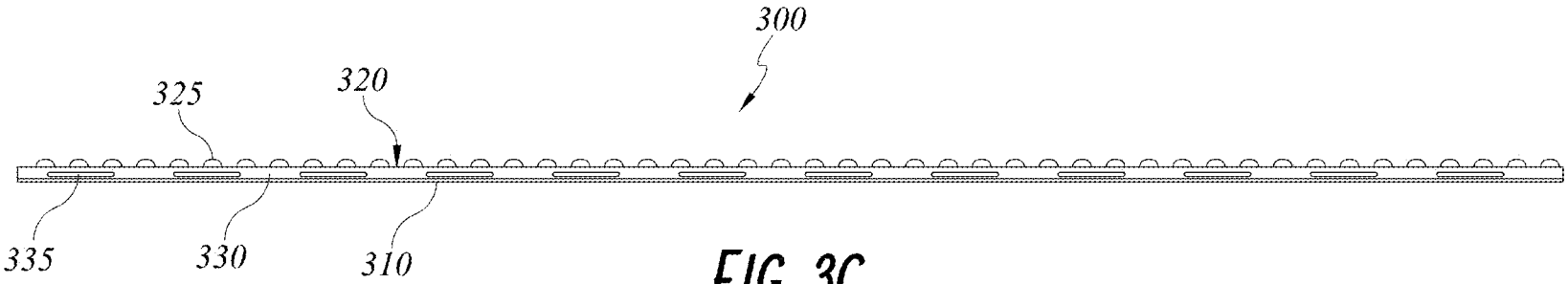
FIG. 3C is a side elevation view of the furring strip of FIGS. 3A and 3B.
Figure 3D:
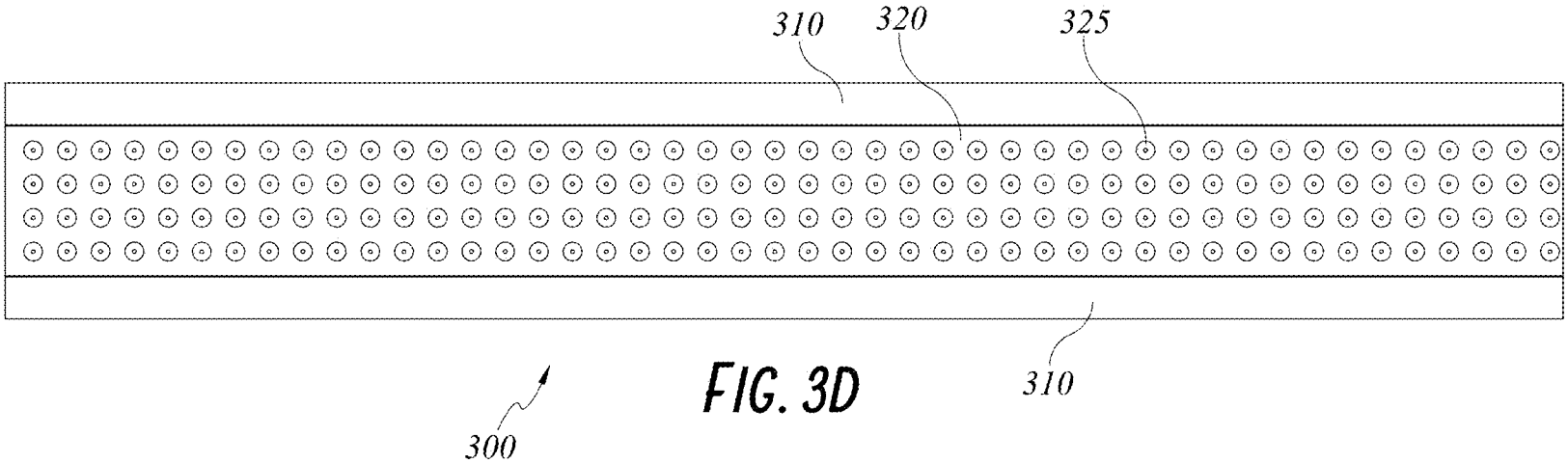
FIG. 3D is a top plan view of the furring strip of FIGS. 3A-3C.
Figure 4A:
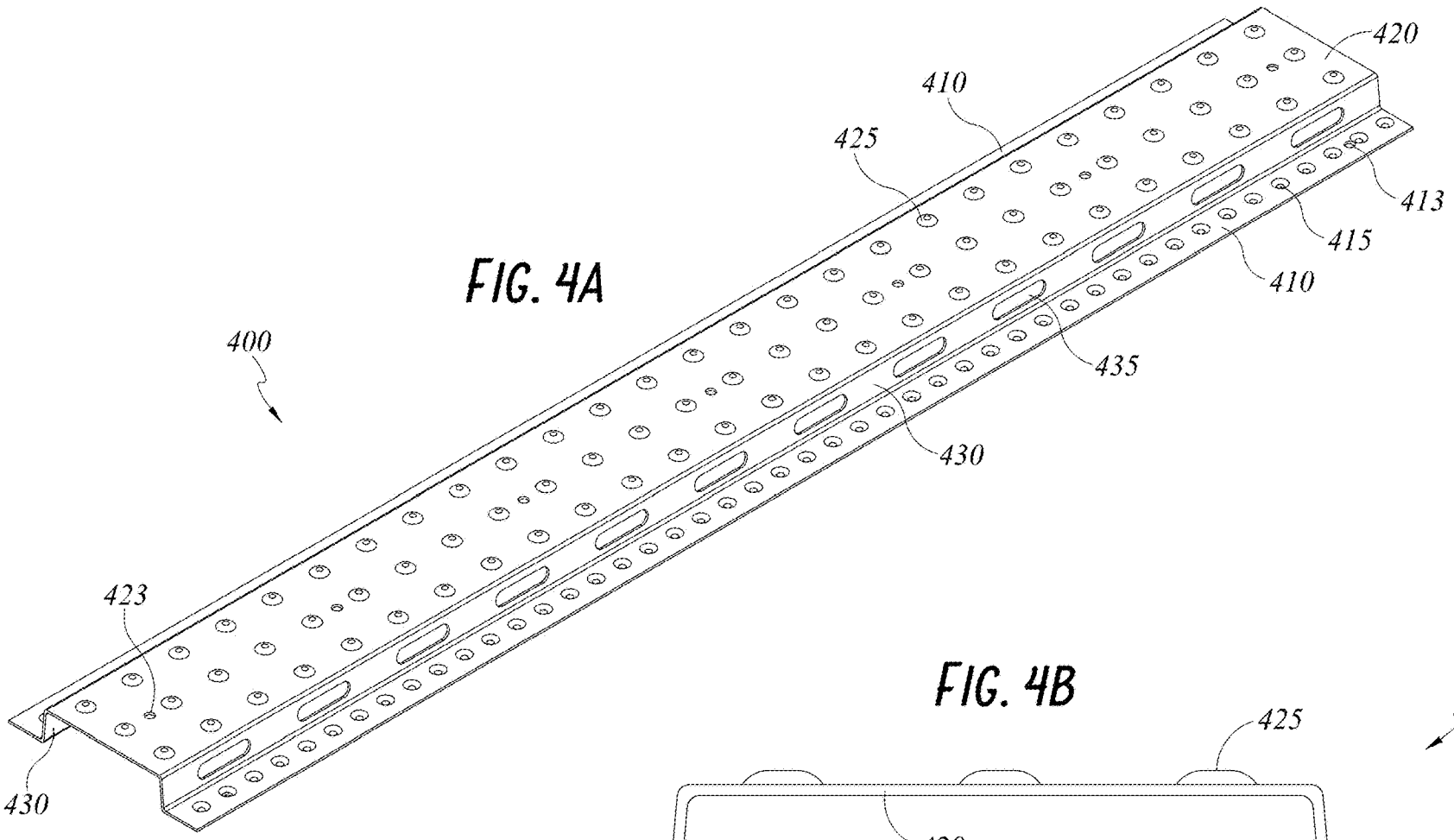
FIG. 4A is a perspective view of a furring strip with drainage features in accordance with a fourth example embodiment.
Figure 4B:
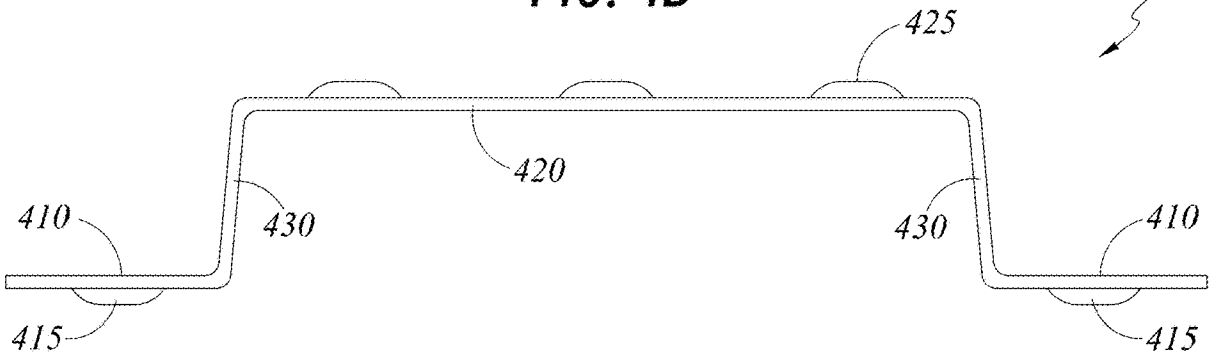
FIG. 4B is an end profile view of the furring strip of FIG. 4A, illustrating an example configuration of drainage features incorporated therein.
Figure 4C:
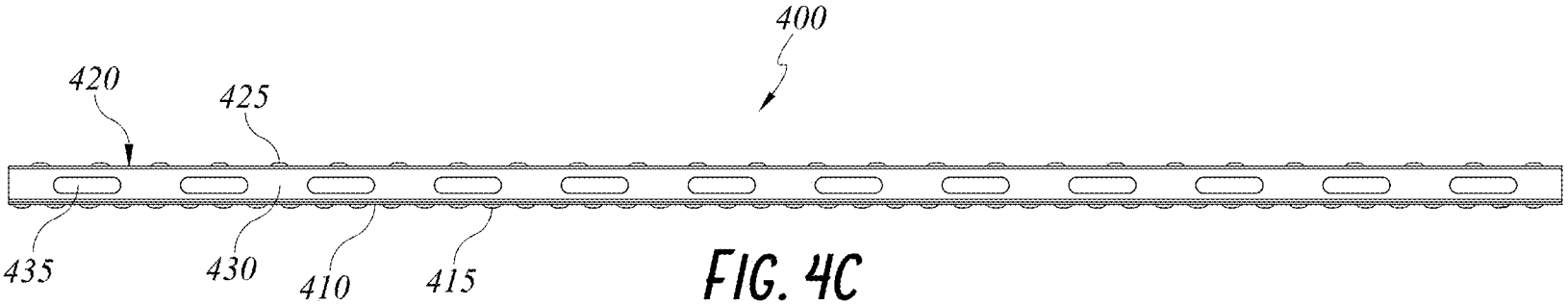
FIG. 4C is a side elevation view of the furring strip of FIGS. 4A and 4B.
Figure 4D:
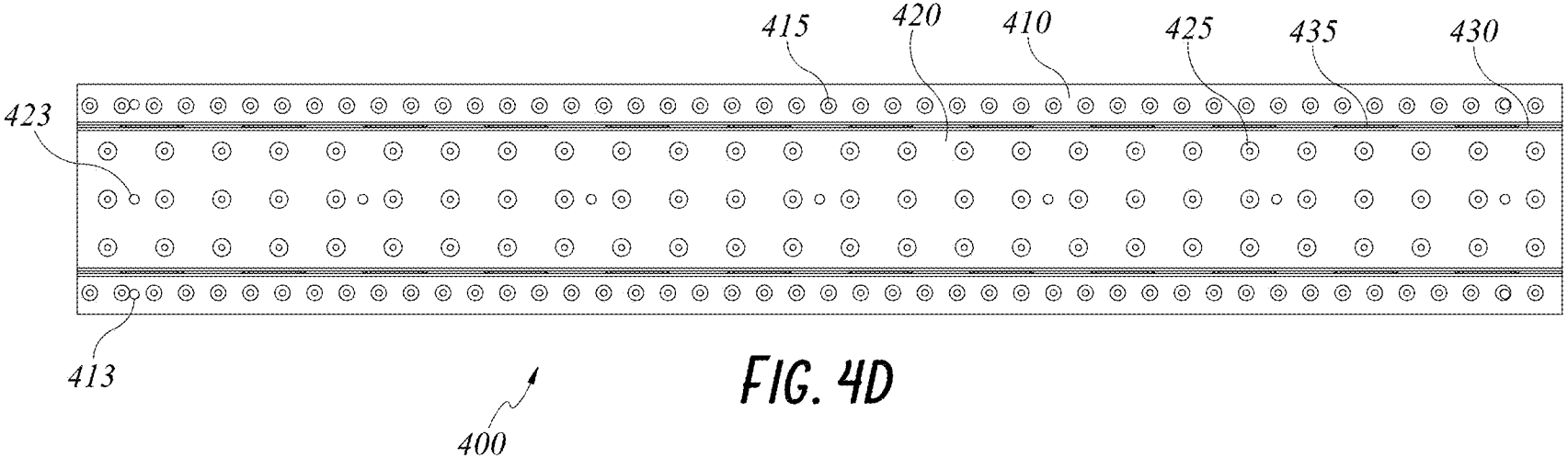
FIG. 4D is a top plan view of the furring strip of FIGS. 4A-4C.
Figure 5A:
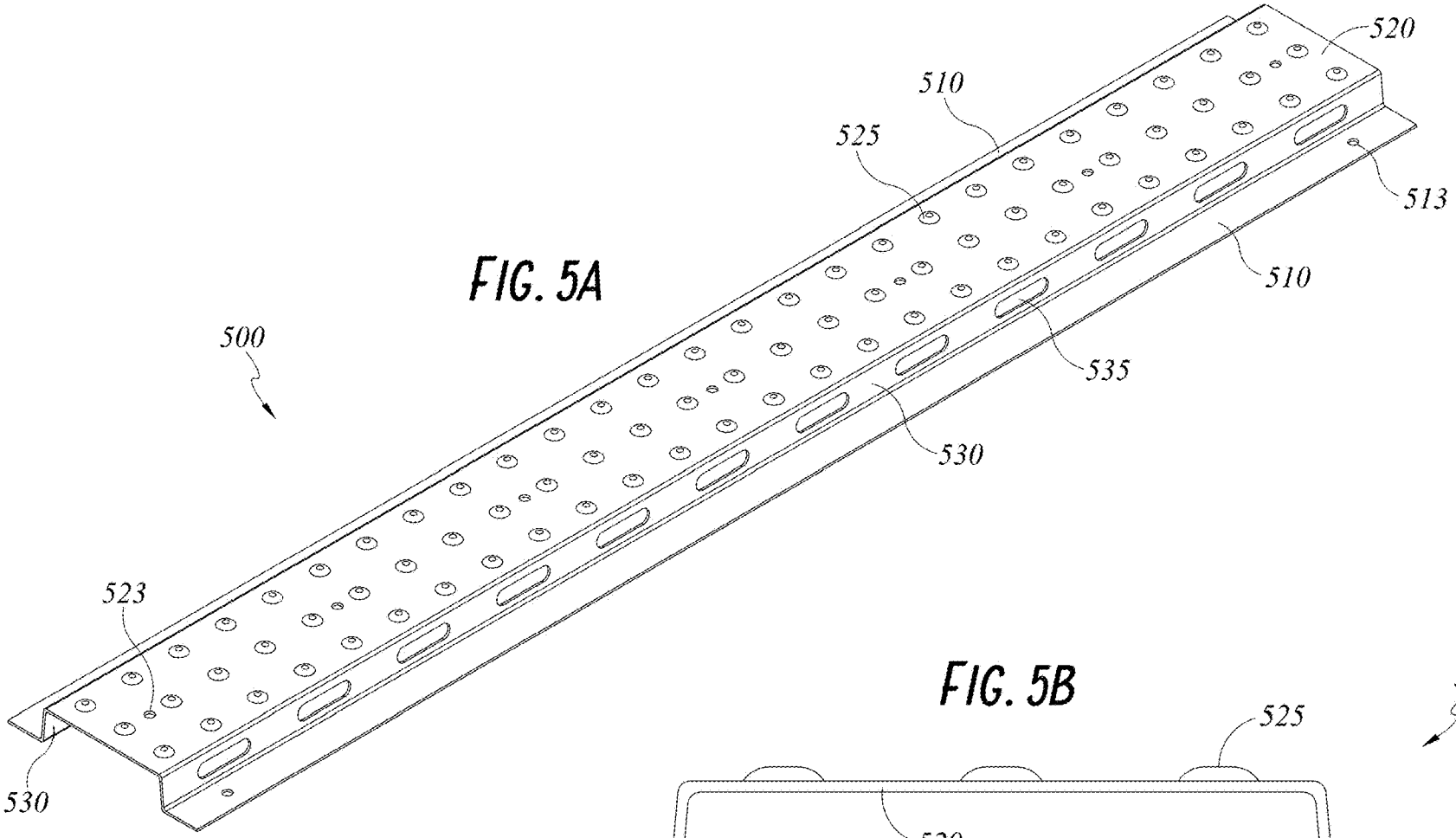
FIG. 5A is a perspective view of a furring strip with drainage features in accordance with a fifth example embodiment.
Figure 5B:
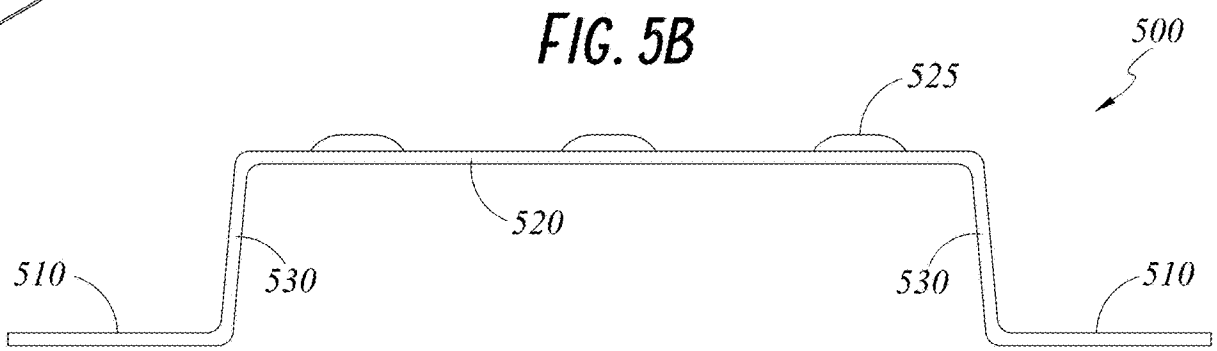
FIG. 5B is an end profile view of the furring strip of FIG. 5A, illustrating an example configuration of drainage features incorporated therein.
Figure 5C:
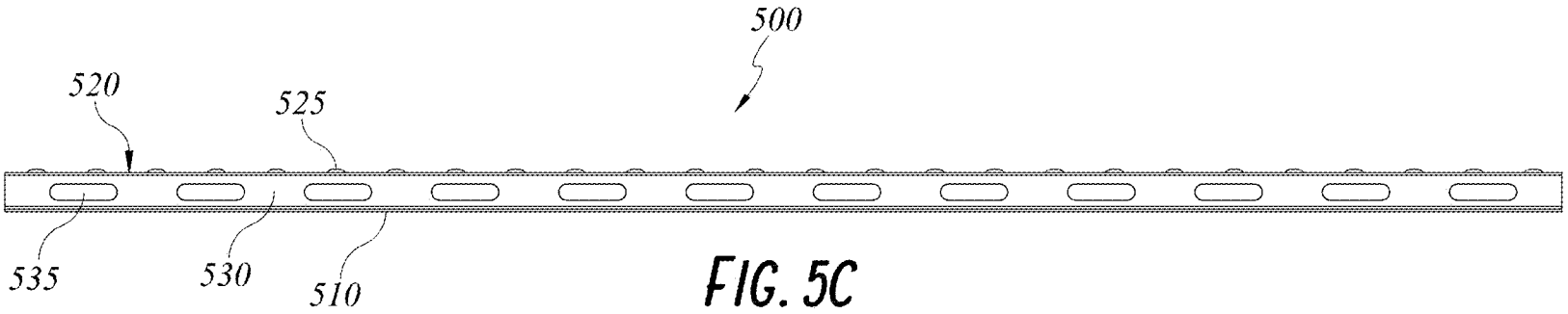
FIG. 5C is a side elevation view of the furring strip of FIGS. 5A and 5B.
Figure 5D:
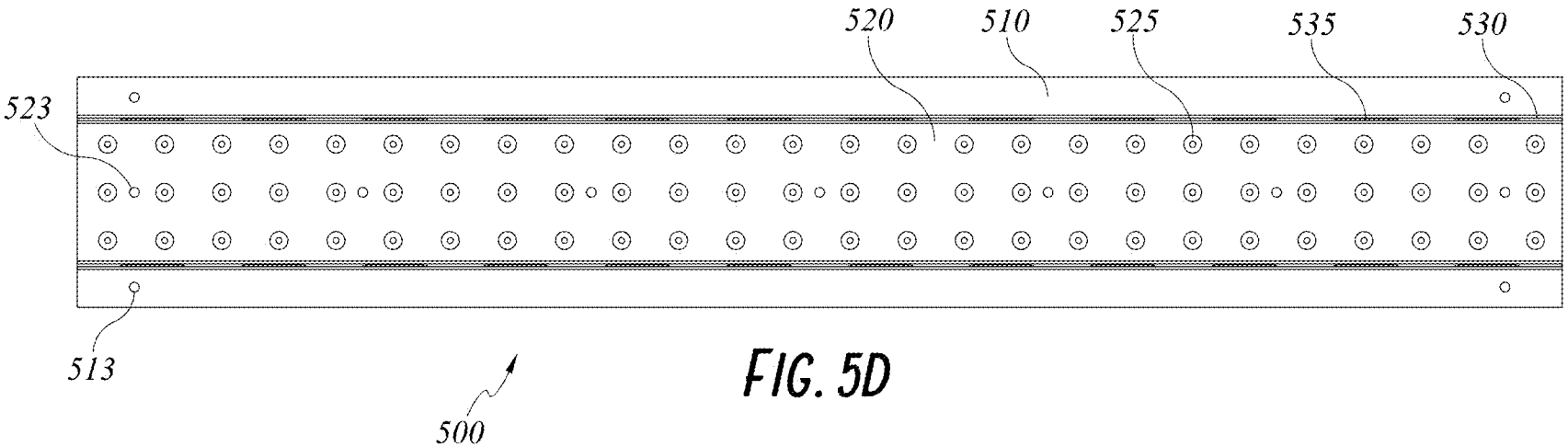
FIG. 5D is a top plan view of the furring strip of FIGS. 5A-5C.
Figure 6A:
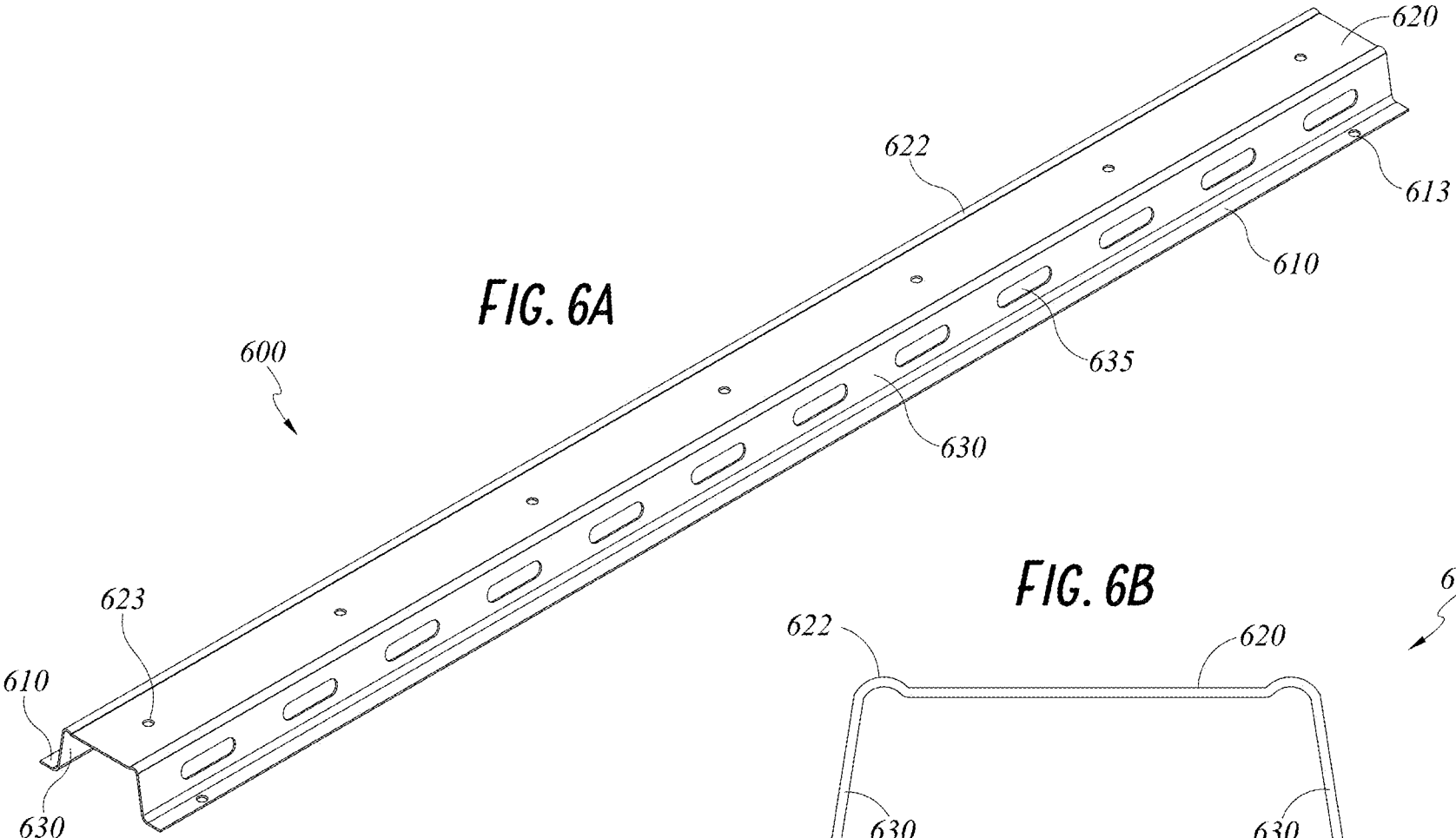
FIG. 6A is a perspective view of a furring strip with drainage functionality in accordance with a sixth example embodiment.
Figure 6B:
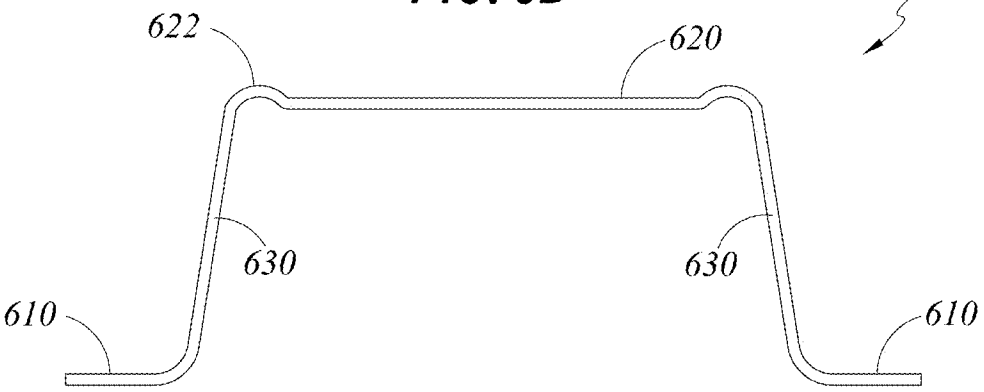
FIG. 6B is an end profile view of the furring strip of FIG. 6A, illustrating an example configuration of drainage features incorporated therein.
Figure 6C:
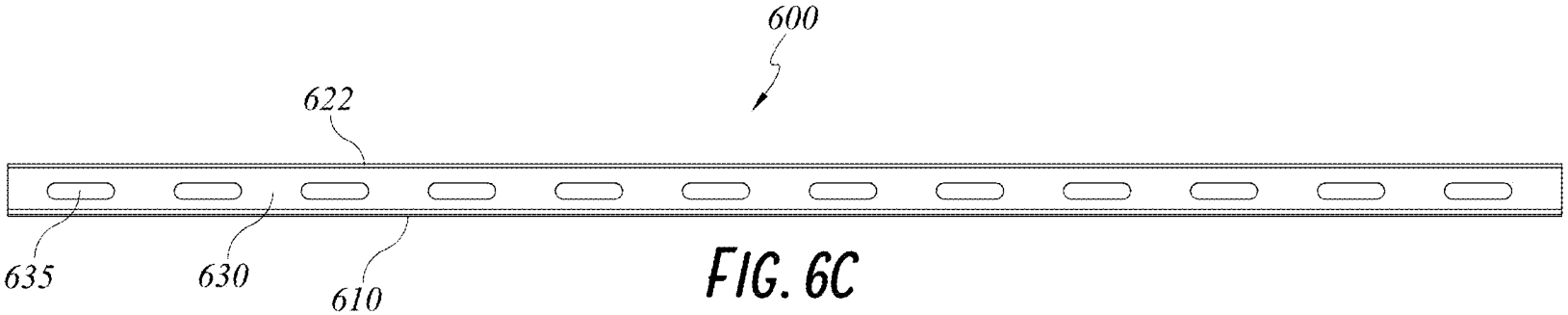
FIG. 6C is a side elevation view of the furring strip of FIGS. 6A and 6B.
Figure 6D:
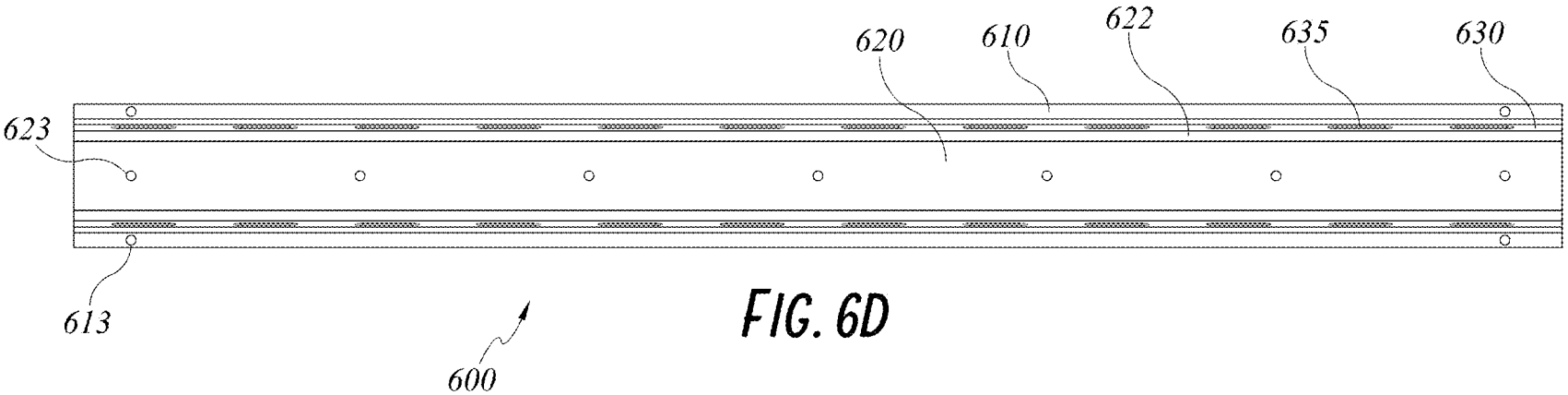
FIG. 6D is a top plan view of the furring strip of FIGS. 6A-6C.

Although the present disclosure is described with reference to specific examples, it will be appreciated that the present disclosure may be embodied in many other forms. The embodiments discussed herein are merely illustrative and do not limit the scope of the present disclosure.

In the description which follows, like parts may be marked throughout the specification and drawings with the same reference numerals. The drawing figures are not necessarily to scale and certain features may be shown exaggerated in scale or in somewhat generalized or schematic form in the interest of clarity and conciseness.

Figure 7B:
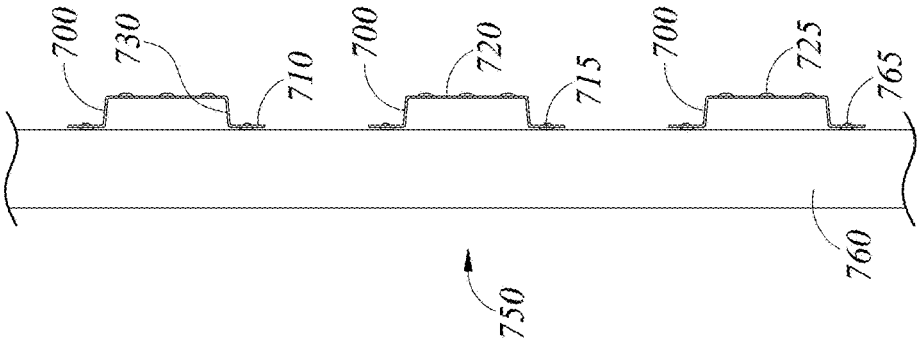
FIG. 7B is a side profile view of the system of FIG. 7A.

To assist in the description of various components of the furring systems described herein, the following coordinate terms are used (see, e.g., FIGS. 1A-1B). A "length" of a furring strip generally refers to the longest dimension of the furring strip embodiments depicted. A "width" is the dimension normal to the length and parallel to the plane of the faces and legs of a furring strip. A "height" is the dimension normal to the length and width. For example, the perspective view of FIG. 1A depicts a furring strip having a length along the direction of the z axis, a width along the direction of the x axis, and a height along the direction of the y axis. An "inner" surface or component is generally configured to be disposed proximal to and/or oriented toward a building substrate, and an "outer" surface or component is generally configured to be disposed distal to and/or oriented away from a building substrate. For example, the view of FIG. 7B depicts several furring strips having legs 710 disposed at the inner end of webs 730, and a face 720 disposed at the outer end of webs 730. Although certain dimensions will be provided for various components described and depicted herein, each of the furring strips and components thereof may be implemented with different dimensions in other embodiments, for example, by scaling the dimensions isotropically and/or by independently altering individual dimensions.

Furring has traditionally been installed vertically. Horizontal furring may be desirable in building construction for various reasons, such as to enable a flexible or customizable layout for vertical panel joints, and/or to provide a regular and/or symmetrical layout of cladding fasteners independent of the location of vertical framing members. However, existing furring products typically cannot be installed horizontally because a horizontal configuration tends to cause water to collect above the furring strips, rather than draining downward. Existing furring products thus typically are installed vertically, at locations determined by the location and availability of vertical framing studs, resulting in relatively few options for the location of vertical panel joints.

Generally described, various embodiments of the present disclosure provide a furring system comprising multifunctional furring strips that can be installed in a horizontal orientation, a vertical orientation, or an orientation between horizontal and vertical, while providing desirable drainage, ventilation, and wind load resistance attributes in any such orientation. Furring strips described herein can be installed horizontally to a building substrate, and exterior cladding articles of various weights, such as fiber cement siding or the like, can be secured to the furring strips to create a rain screen system including an air gap between the exterior cladding and the building substrate. When the furring strips described herein are installed as part of a rain screen system, surface dimples can provide a capillary break, drainage channel, or ventilation space at one or more interfaces between the furring strips and the building substrate or exterior cladding. Certain embodiments of the furring strips disclosed herein have dimples with a combination of dimple height and dimple spacing configured to provide desirable drainage in a horizontal configuration, while also providing reliable wind load resistance and prevention of blowout or nail pull-through. For example, certain embodiments of the furring strips disclosed herein may provide up to three gravity-assisted fluid flow paths (e.g., between the legs and a building substrate, between the face and a cladding, and/or through web openings).

Some embodiments of the present disclosure provide drained furring tape that can be applied to existing furring strips that lack sufficient drainage when installed horizontally. Drained furring tapes can be adhesive tapes having an outer surface with an array of raised drainage features. Thus, a length of furring tape can be applied to an outward-facing surface of a commercially available flat furring strip, such as a metal hat channel or wood furring strip, to produce a drained furring strip that can be installed in a horizontal configuration in a rainscreen system.

FIGS. 1A-1D depict a first embodiment of a furring strip 100 incorporating drainage functionality. The furring strip 100 is a lineal structural member having a profile defined generally by legs 110, a face 120, and webs 130 disposed between and contiguous with the legs 110 and the face 120. The legs 110 are substantially planar and include leg dimples 115 spaced along the length of each leg 110. Similarly, the face 120 is substantially planar and parallel to the legs 110, with face dimples 125 spaced in an array along the length and width of the face 120. Webs 130 extend between the lateral ends of the face 120 and the medial ends of the legs 110, with web openings 135 spaced along the length of the webs 130. The dimples 115, 125, and web openings 135 provide enhanced drainage and ventilation, as will be described in greater detail below.

The furring strip 100 is configured to be installed adjacent to a building substrate to secure a cladding article, such as a fiber cement panel or the like, to the building substrate in a spaced configuration to form an air gap. The furring strip 100 is generally configured for installation such that the legs 110 and/or leg dimples 115 are adjacent to the building substrate along the length of the furring strip 100 and/or at various locations along the furring strip 100 (e.g., if the furring strip 100 is mounted to a plurality of discrete structural members such as studs, rather than to a sheathing or other continuous substrate), and the face 120 and/or face dimples 125 are adjacent to the cladding article, so as to form an air gap having a width determined by the height 132 of the furring strip 100 (as shown in FIG. 1B). Mechanical fastening means can be used to secure the legs 110 to the building substrate and to secure the cladding article to the face 120. Installation of strips such as furring strip 100 with cladding and building substrates is discussed in greater detail below with reference to FIGS. 7A-8B.

All or a portion of the furring strip 100 can be made from any suitable material, for example, a metal such as steel, aluminum, or the like. In some embodiments, the furring strip 100 comprises a single piece of steel of a suitable thickness to retain dimensional stability when coupled to a building substrate and a cladding article. For example, the furring strip 100 can be manufactured from sheet steel, for example, bare metal sheet steel or corrosion-treated sheet steel, having a thickness between 20 gauge (0.0329 inches or 0.836 mm) and 16 gauge (0.0538 inches or 1.367 mm). In embodiments comprising sheet steel, the furring strip 100 can be manufactured by rolling, extruding, pressing, or the like. In some embodiments, the furring strip 100 is manufactured by producing the dimples 115, 125 and punching, laser cutting, or otherwise creating the web openings 135 into a strip of sheet steel, and then forming the pre-textured strip with web openings 135 into the final channel shape using a roll form or the like. In some embodiments, the metal material may further have a fine profile, or surface texture, on the outer surfaces 110*a*, 120*a* of the legs 110 and face 120, for example, to assist in the orientation of mechanical fasteners being driven through the furring strip 100 and prevent unintended lateral movement (e.g., "walking" or "wandering") of mechanical fastener tips when being driven through the furring strip 100.

As shown in greater detail in FIG. 1B, several features of the profile of the furring strip 100 are configured to provide enhanced drainage functionality. Each leg 110 has an outer leg surface 110*a* and an inner leg surface 110*b*. Each leg dimple 115 includes a recess 115*a* of the outer leg surface 110*a*, and a corresponding protrusion 115*b* of the inner leg surface 110*b*. Similarly, the face 120 has an outer face surface 120*a* and an inner face surface 120*b*. Each face dimple 125 includes a protrusion 125*a* of the outer face surface 120*a*, and a corresponding recess 125*b* of the inner face surface 120*b*.

Dimples are generally characterized by a dimple spacing 126 and a dimple height 127. As used herein, the dimple spacing 126 is the lateral displacement (e.g., in the x or z direction of FIGS. 1A-1D) between the centers of adjacent dimples 115, 125. Dimple spacing may refer to the spacing of face dimples 125 along the width of the face 120, and/or the spacing of leg dimples 115 or face dimples 125 along the length of the leg 110 or face 120. The dimple height 127 is the vertical displacement (e.g., in they direction of FIGS. 1A-1D) between the outer face surface 120*a* and the center of the protrusion 125*a*. For a leg dimple 115, the dimple height 127 can similarly be measured as the vertical displacement between the inner leg surface 110*b* and the center of the protrusion 115*b*.

The webs 130 are disposed between the legs 110 and the face 120 and extend from the legs 110 and face 120 at an intersection defined by a web angle φ between the web 130 and either the outer leg surface 110*a* or the inner face surface 120*b*. The web angle φ can be acute, right, or obtuse, however, an obtuse web angle web angle φ greater than 90° may advantageously facilitate drainage when the furring strip 100 is installed against a vertical building substrate, such that the direction of gravity is substantially along the x axis. Thus, the height 132 of the furring strip 100, as generally defined by the vertical displacement between the center of the protrusions 115*b* of the inner leg surface 110*b* and the center of the protrusions 125*a* of the outer face surface 120*a*, is at least partially dependent on the length of the webs 130 and on the web angle φ. In the example embodiment shown in FIGS. 1A-1D, the angle φ is approximately 95°.

The example furring strip 100 shown in FIGS. 1A-1D has a height 132 of 0.75 inches (19.05 mm). The dimples of the furring strip 100 have a diameter of 0.3125 inches (7.938 mm) and a dimple height of 127 of 0.0626 inches (1.5875 mm). The face dimples 125 are arranged in a regular grid pattern with a dimple spacing 126 of 0.5625 inches (14.288 mm) along both the length and the width of the face 120. Thus, the face dimples 125 may cover 20%-28% of the face 120. The leg dimples 115 are similarly spaced at 0.5625 inches (14.288 mm) along the length of the legs 110. The web openings 135 are oval, elliptical, or obround, having a total length (e.g., a dimension along the length of the furring strip 100) of 1.125 inches (28.575 mm) and a height (e.g., a dimension normal to the length and in the plane of the web 130) of 0.275 inches (6.985 mm), with adjacent web openings 135 being spaced 1 inch (25.4 mm) apart along the length of the web 130. The web openings 135 of each web 130 may be positioned and/or sized to correspond to the web openings 135 of the opposing web 130 so as to facilitate drainage of water through both webs 130 when the furring strip 100 is installed horizontally. These dimensions represent a single example configuration.

Referring now to FIGS. 2A-2D, a second embodiment of a furring strip 200 similarly comprises two legs 210, a face 220, and two webs 230 connecting the legs 210 and the face 220. The furring strip 200 is substantially similar in structure and function to the furring strip 100 depicted in FIGS. 1A-1D, including spaced leg dimples 215 and face dimples 225 arranged in an array of four rows. Unlike the furring strip 100 of FIGS. 1A-1D, the face dimples 225 of the furring strip 200 are arranged in a plurality of offset rows, wherein each row is displaced along the length of the furring strip 200, relative to each adjacent row, e.g., by 0.140625 inches (3.57 mm). As the lengthwise dimple spacing 226 of the face dimples 225 is 0.5625 inches (14.288 mm), the offset between adjacent rows results in a configuration in which no two face dimples 225 are centered on a line along the width of the furring strip 200.

Similar to the furring strip 100 of FIGS. 1A-1D, the furring strip 200 can comprise a metal such as steel. For example, the furring strip 200 can be made of a sheet steel having a width between 20 gauge and 16 gauge, and can be manufactured by rolling, extruding, pressing, or the like. In some embodiments, the furring strip 200 is manufactured by producing the dimples 215, 225 and punching the web openings 235 into a strip of sheet steel, and then forming the pre-textured and pre-punched strip into the final channel shape using a roll form or the like.

FIGS. 3A-3D depict a third embodiment of a furring strip 300 incorporating drainage functionality similar to the furring strips 100, 200 described above. The furring strip 300 includes legs 310, a face 320, and webs 330 connecting the legs 310 and the face 320. The face 320 includes face dimples 325 in a regular array configuration. Similar to the furring strip 100 of FIGS. 1A-1D, the face dimples 325 have a diameter of 0.3125 inches (7.938 mm) and are spaced along the length and width of the face 320 at 0.5625 inches (14.288 mm).

The furring strip 300 has a total height (as measured from the inner surface 310*b* of the legs 310 to the center of the protrusion 325*a* of the face dimples 325) of 0.375 inches (9.525 mm). The face dimples 325 have a height of 0.125 inches (3.175 mm). Due to the relatively shorter height of the webs 330 relative to the webs 130, 230 of FIGS. 1A-2D, web openings 335 of the furring strip 300 have a length of 1.125 inches (28.575 mm) and a height of 0.071 inches (1.8034 mm).

In some embodiments, such as the furring strip 300 shown in FIGS. 3A-3D, the legs 310 of the furring strip 300 are substantially flat and do not include leg dimples as shown in FIGS. 1A-2D. In such embodiments, the inner surface 310*b* of the legs 310 is positioned directly against a building substrate when installed, and drainage occurs primarily through the web openings 335 and face dimples 325.

FIGS. 4A-4D depict a fourth embodiment of a furring strip 400. The furring strip 400 includes legs 410, a face 420, and webs 430 disposed between the legs 410 and the face 420. Similar to the furring strip 100 depicted in FIGS. 1A-1D, the furring strip 400 has a height of 0.75 inches (19.05 mm) with a dimple diameter of 0.3125 inches (7.938 mm) and a dimple height of 0.0626 inches (1.5875 mm). As compared to the furring strip 100 of FIGS. 1A-1D, the furring strip 400 has a relatively larger dimple spacing, with face dimples 425 spaced 0.84 inches (21.336 mm) apart along the width of the face 420, and 1 inch (25.4 mm) apart along the length of the face 420. Accordingly, each row of face dimples 425 (e.g., along the width of the face 420) is a row of 3 dimples, rather than 4 dimples as in the furring strip 100 of FIGS. 1A-1D. Accordingly, the face dimples 425 may cover 16%-20% of the face 420. The spacing of leg dimples 415 can be independent of the face dimple 425 spacing, and may be the same or different from the leg dimple 415 spacing of FIGS. 1A-1D.

In some embodiments, such as the example furring strip 400, apertures 413, 423 can be provided in the legs 410 and face 420 respectively, to accommodate mechanical fasteners for securing the furring strip 400 to a building substrate or cladding article. Apertures 413, 423 may be desirable, for example, where relatively thick materials are used in the construction of the furring strip 400.

FIGS. 5A-5D depict a fifth embodiment of a furring strip 500. The furring strip 500 includes legs 510 including apertures 413 for mechanical fasteners, a face 520 including face dimples 525 and apertures 523 for mechanical fasteners, and webs 530 disposed between the legs 510 and the face 520, the webs 530 including web openings 535. Similar to the furring strip 400 depicted in FIGS. 4A-4D, the furring strip 500 has a height of 0.75 inches (19.05 mm) with a dimple diameter of 0.3125 inches (7.938 mm) and a dimple height 127 of 0.0626 inches (1.5875 mm). Similar to the furring strip 300 depicted in FIGS. 3A-3D, the legs 510 of the furring strip 500 are substantially flat and do not include leg dimples. Thus, to achieve the same height as the furring strip 400 of FIGS. 4A-4D, the webs 530 may be longer relative to those of the furring strip 400.

In some embodiments, as shown for example in FIGS. 6A-6D, a furring strip 600 can have substantially flat legs 610 and a substantially flat face 620 without dimples. In such embodiments, drainage can occur primarily through web openings 635 in webs 630. In the example of FIGS. 6A-6D, the furring strip 600 has a height of 0.875 inches (22.225 mm). In some aspects, additional features of the profile of the furring strip 600 can include ridges 622 at lateral edges of the face 620 of the furring strip 600. The example furring strip 600 may optionally include apertures 613 and 623 to accommodate mechanical fasteners, as described with reference to previous examples above.

Referring now to FIGS. 7A-8B, example furring strip installation methods and configurations will be described. Although the furring strips 700, 800 depicted in FIGS. 7A-8B are consistent with the furring strip 400 depicted and described with reference to FIGS. 4A-4D, it will be appreciated that the configurations and methods of FIGS. 7A-8B can equally be implemented with any of the other furring strip embodiments depicted and described herein, for example, with reference to FIGS. 1A-3D and 5A-6D.

Figure 7A:
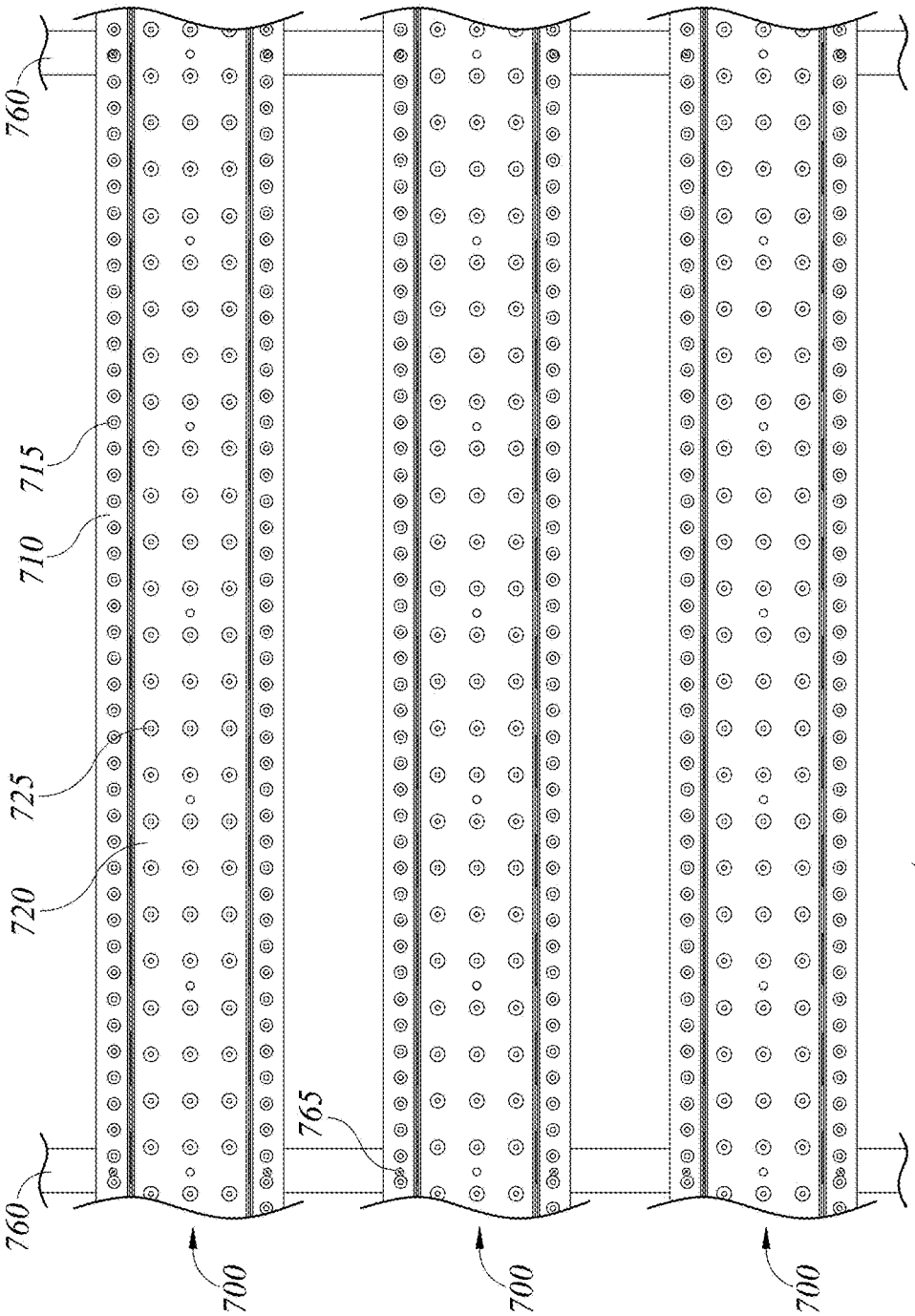
FIG. 7A is a front elevation view of a structural furring system including a plurality of furring strips installed on a building substrate.

As shown in FIGS. 7A and 7B, an example structural furring system 750 includes one or more furring strips 700 attached in a horizontal orientation to a building substrate 760. In various embodiments, the building substrate can include one or more of studs or other horizontal or vertical framing members, a planar exterior sheathing such as plywood or oriented strand board (OSB), a housewrap or other weather-resistant material, or any other building material to which an interior or exterior cladding is to be applied. In the example structural furring system 750, the building substrate comprises vertically oriented studs in a laterally spaced configuration, for example, along an exterior wall of a building.

Conveniently, and in contrast to existing vertically oriented furring, the furring strips 700 can be mounted in a horizontal configuration as shown in FIGS. 7A-7B. In a horizontal configuration, the furring strips 700 can be mounted at any desired spacing, and can be fastened equally to the building substrate 760 by mechanical fasteners 765 for any stud spacing. As shown in FIGS. 7A-7B, each furring strip 700 includes legs 710 which are fastened to the building substrate 760 such that a face 720 of the furring strip 700 is spaced outward from the building substrate 760.

Figure 8B:
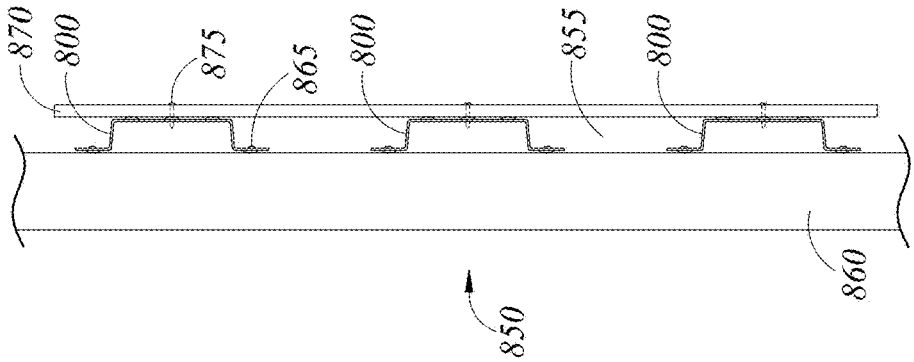
FIG. 8B is a side profile view of the system of FIG. 8A.
Figure 8A:
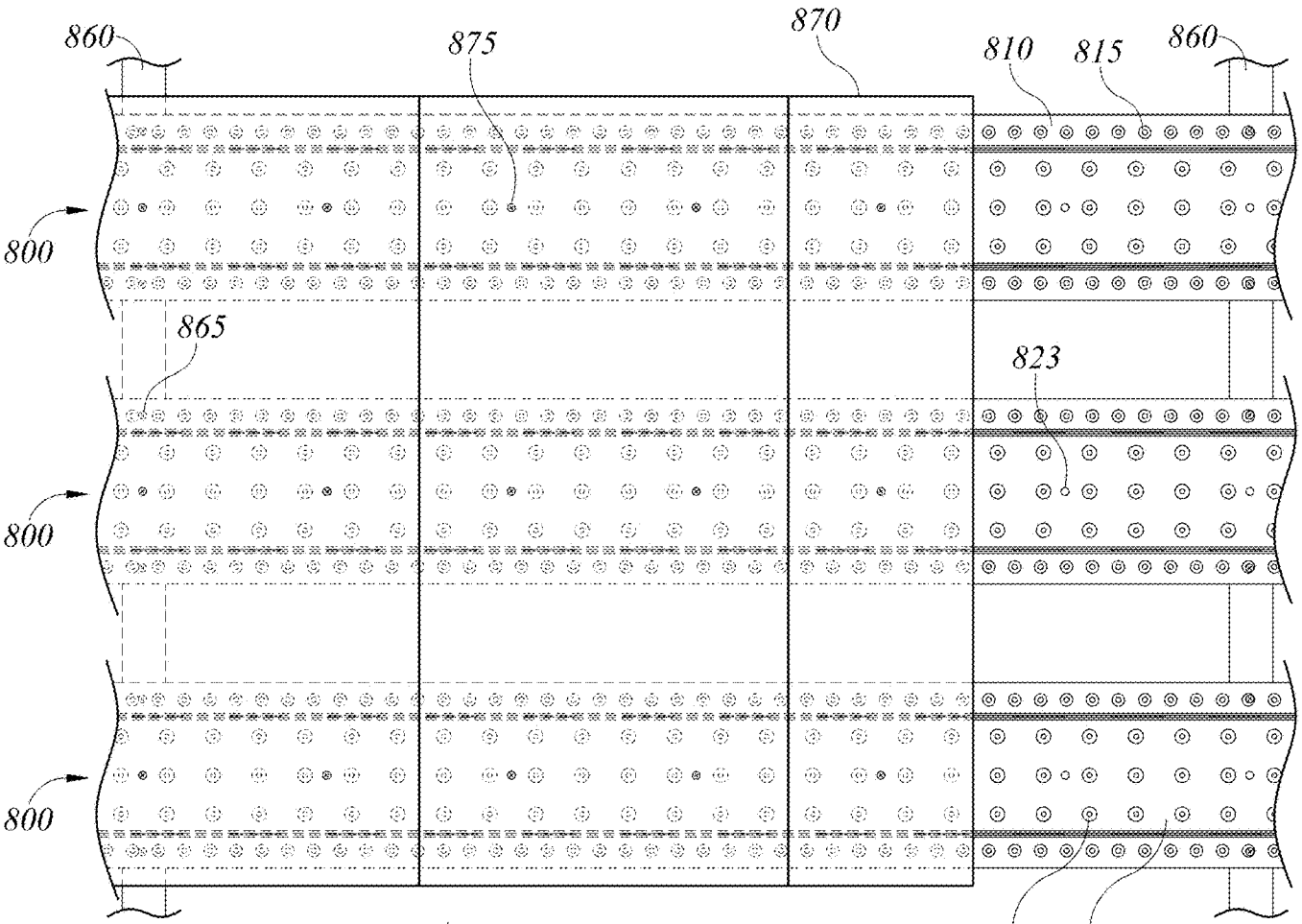
FIG. 8A is a front elevation view of a rain screen system including cladding articles secured to the furring strips of FIG. 7A.

With reference to FIGS. 8A-8B, a rain screen system 850 can further include one or more exterior cladding articles 870 secured to a building substrate 860 by furring strips 800. As in the structural furring system 750 of FIGS. 7A-7B, the furring strips 800 are fastened to the building substrate 860 by mechanical fasteners 865, such as screws, nails, or the like. Exterior cladding articles 870, for example, fiber cement cladding panels, vinyl cladding panels, or the like, can then be fastened to the furring strips 800 by mechanical fasteners 875 such as nails, screws, or the like, to create an air gap 855 as part of the rain screen system 850. Because mechanical fasteners 875 are configured to secure an exterior cladding article 870 to a furring strip 800, while mechanical fasteners 865 are configured to secure a furring strip 800 to a building substrate 860, it will be appreciated that mechanical fasteners 875 can be similar or different from mechanical fasteners 865, based at least in part on the materials comprising the building substrate 860, the furring strips 800, and the cladding articles 870.

With continued reference to FIGS. 8A-8B, an example method of installing a cladding will now be described. The method begins by placing a first furring strip 800 in a desired position for installation with the legs 810 and/or leg dimples 815 adjacent to the building substrate 860. The first furring strip 800 can then be secured to the building substrate 860, for example, by a plurality of mechanical fasteners 865 such as nails or screws, which may be driven through the legs 810 between the leg dimples 815 and/or through apertures within the legs 810. Further furring strips 800 may then be installed at a desired spacing to yield a configuration similar to the system 750 depicted in FIGS. 7A and 7B. When a plurality of furring strips 800 have been installed, one or more exterior cladding articles 870 are obtained. A first one of the exterior cladding articles 870 is placed into a desired position for installation, with an inner surface of the first exterior cladding article 870 adjacent to the face 820 and/or face dimples 825 of the furring strips 800. The first exterior cladding article 870 can then be secured to the furring strips 800, for example, by one or more mechanical fasteners 875 such as nails or screws, with may be driven through the face 820 and/or through apertures 823 within the face 820. Further exterior cladding articles 870 may then be installed at a desired spacing and/or adjacent to the first exterior cladding article 870 to yield a completed rain screen system 850.

Figure 9A:
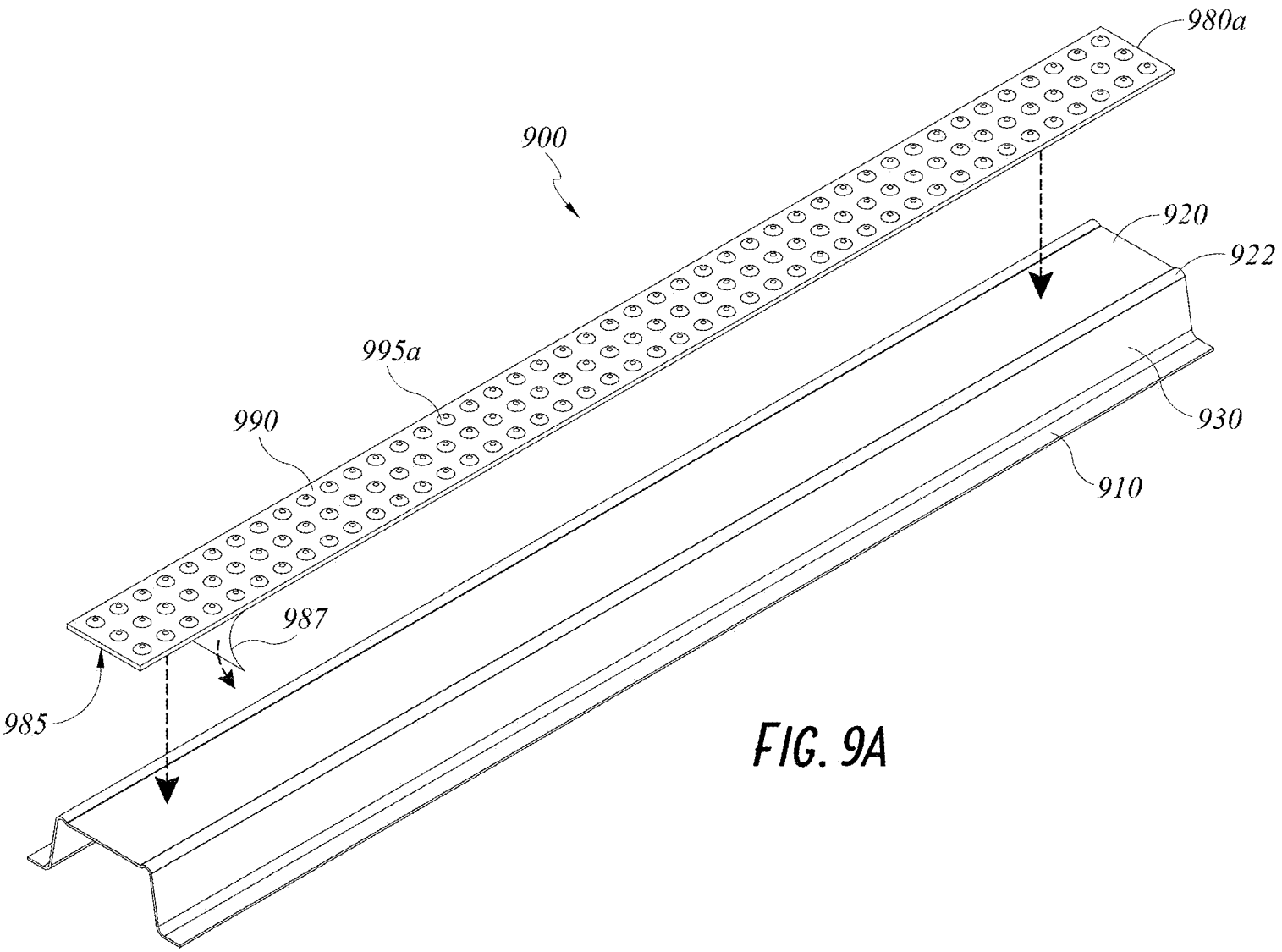
FIG. 9A is a perspective view of a furring strip and a textured adhesive tape configured to provide rain screen drainage functionality when applied to the furring strip.

Referring now to FIG. 9A, in some embodiments, drainage functionality can be achieved by the application of a drainage layer 980*a*, such as an adhesive tape, to a furring strip 900 that has a substantially flat face 920 and substantially flat legs 910. In various embodiments, the furring strip 900 can be a lineal metallic strip, for example, a commercially profile such as a hat channel, furring channel, u channel, or the like. In other embodiments, the furring strip 900 can be a wooden furring strip having a generally rectangular cross-sectional profile. Similar to the furring strip 600 of FIGS. 6A-6D, the example furring strip 900 of FIG. 9A includes ridges 922 at lateral edges of the face 920 adjacent to webs 930. Accordingly, the drainage layer 980*a* can advantageously allow existing vertical furring materials to be mounted in a horizontal configuration, thereby providing more flexible installation configurations.

The example drainage layer 980*a* depicted in FIG. 9A comprises an adhesive tape including an inner surface 985 at least partially coated with a chemical adhesive, such as a glue, and a substantially planar outer surface 990 having one or more drainage features included thereon. For example, in FIG. 9A, the drainage features are generally round dimples 995*a* configured to provide a capillary break similar to the dimples depicted previously in FIGS. 1A-8B. A removable backing 987 can be coupled to the inner surface 985 to protect the chemical adhesive on the inner surface 985, and removed before attachment to the furring strip 900. Thus, when the drainage layer 980*a* is coupled to the face 920 of the furring strip 900, the resulting combination is a furring strip 900 with integrated drainage functionality similar to other furring strip embodiments described herein.

Figure 9D:
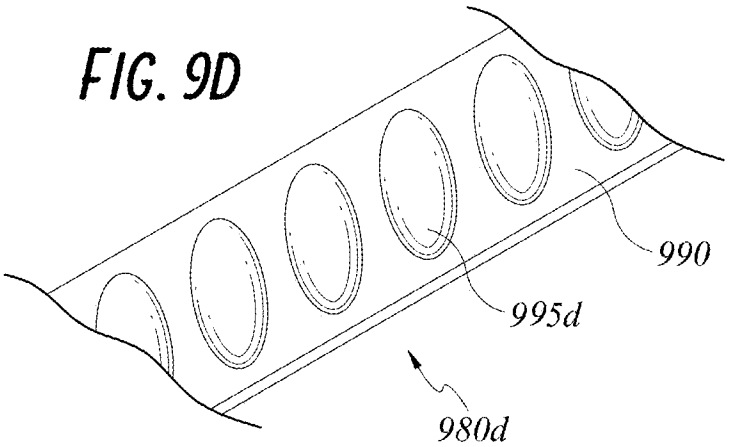
FIGS. 9B-9G depict alternative surface texture configurations of the adhesive tape depicted in FIG. 9A.
Figure 9E:
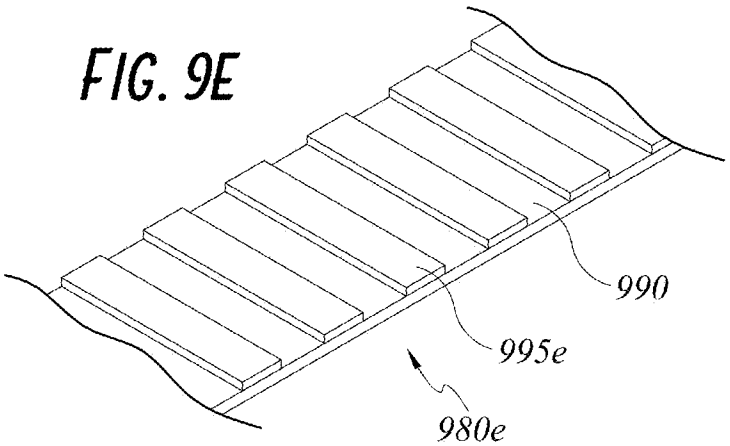
Figure 9B:
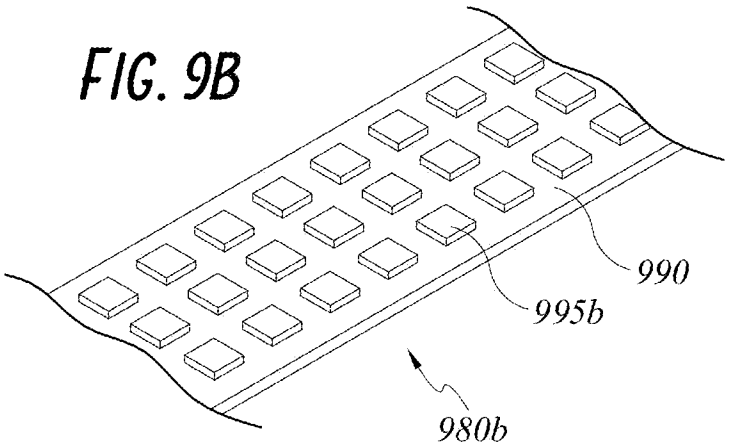

Referring now to FIGS. 9B-9G, a variety of shapes and configurations of drainage features can be implemented with the adhesive drainage layers described herein. For example, the outer surface 990 of a drainage layer 980*b* as shown in FIG. 9B includes drainage features 995*b* in the form of square or diamond-shaped protrusions from the outer surface 990.

Figure 9C:
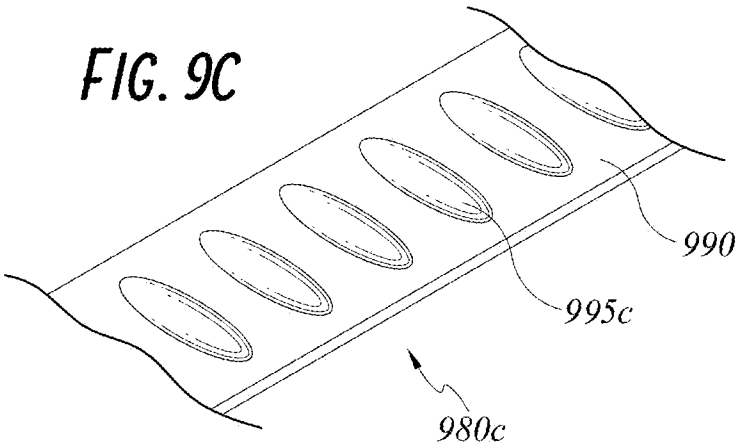

In a further example, as shown in FIG. 9C, a drainage layer 980*c* includes drainage features 995*c* comprising oval, elliptical, or obround protrusions from the upper surface 990. The drainage features 995*c* are oriented along the width of the outer surface 990, such that a vertical drainage channel is created when the furring strip 900 (FIG. 9A) is installed in a horizontal configuration between a building substrate and a cladding article.

Referring now to FIG. 9D, a drainage layer 980*d* includes oval, elliptical, or obround drainage features 995*d* similar to the drainage features 995*c* depicted in FIG. 9C. In the drainage layer 980*d*, the drainage features 995*d* are oriented diagonally on the outer surface 990. Thus, a furring strip 900 (FIG. 9A) with the drainage layer 980*d* can be installed in either a horizontal or vertical configuration while still creating a diagonally downward drainage channel adjacent to an installed cladding article.

FIG. 9E depicts an alternative embodiment of a drainage layer 980*e* including drainage features 995*e* in the form of alternating thicker and thinner portions of the drainage layer 980. The drainage features 995*e* are oriented along the width of the outer surface 990, such that a vertical drainage channel is created when the furring strip 900 (FIG. 9A) is installed in a horizontal configuration between a building substrate and a cladding article.

Figure 9F:
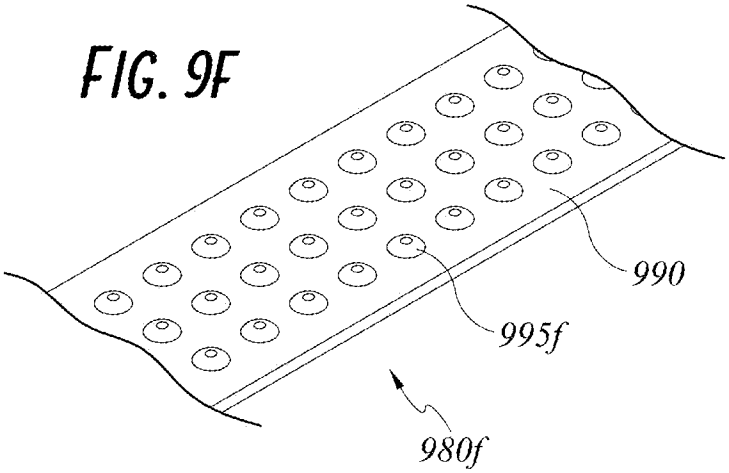
Figure 9G:
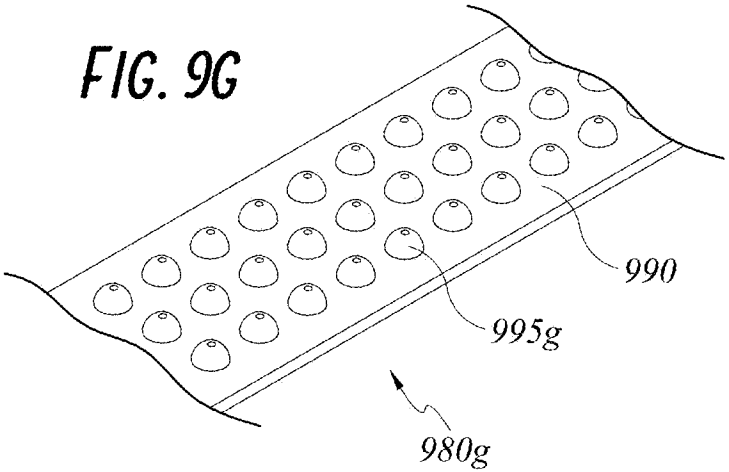

Referring jointly to FIGS. 9F and 9G, drainage layers 980*f*, 980*g* for application with furring strips 900 (FIG. 9A) can include drainage features 995*f*, 995*g* of different heights, for example, based on the furring strips 900 to be used with the drainage layers 980*f*, 980*g*. The drainage features 995*g* of FIG. 9G are relatively taller than the drainage features 995*f* of FIG. 9F. Thus, the drainage layer 980*g* will generally create a wider drainage and ventilation channel when installed with a cladding article, relative to the drainage layer 980*f*. Accordingly, in some implementations, it may be desirable to use the drainage layer 980*g* with a wood furring strip or a furring strip 900 as depicted in FIG. 9A, which does not have any integrated drainage functionality, and to use the drainage layer 980*f* with a furring strip that already includes limited drainage and/or ventilation functionality (e.g., the furring strip 600 depicted in FIGS. 6A-6D, which has web openings 638 but no drainage features on the legs 610 or face 620).

Wind Load Deformation Testing

Wind load capacity is determined by calculating the applied load capacity in accordance with ASTM E-330, "The Standard Test Method for Structural Performance of Exterior Windows, Doors, Skylights and Curtain Walls by Uniform Static Air Pressure Difference." The test measures the uniform static air pressure difference, inward and outward for which the building system and/or rainscreen system are designed to withstand under load conditions. The test monitors the displacement or change in dimensions of the system after the applied load has been removed. In accordance with the test, a series of wind load model deformation tests were carried out to determine the ability of the various furring strip configurations to withstand an outward loading consistent with expected wind load conditions. In a first set of model tests, the model furring strips 100, 200, and 300, and an existing commercially available hat channel strip, were each fastened to two studs spaced 24 inches (0.6096 m) apart, with two fasteners securing each furring strip to each stud. The four strips were then loaded at 20 lbf (88.96 N) outward from the center of each strip midway between the two studs, simulating the outward force of wind loading created at the fastening point of a cladding panel fixed to the furring strips. The maximum outward deformation of each strip due to the outward loading was measured, as presented below in Table 1.

TABLE 1

Results of wind load deformation tests of example furring strips 100, 200, 300 relative to commercially available furring without drainage.

| | Maximum Deformation |
|---|---|
| Commercially Available Hat Channel | 0.010 inches (0.254 mm) |
| Furring Strip 100 | 0.013 inches (0.3302 mm) |
| Furring Strip 200 | 0.014 inches (0.3556 mm) |
| Furring Strip 300 | 0.057 inches (1.448 mm) |

In a second set of model tests, the furring strips 400, 500, 600, were tested, along with an example commercially available hat channel, in accordance with the ASTM E-330 standard test for wind load resistance. Each of model furring strips 400, 500, and 600 was made from 16 ga steel, and a 20 ga version of strip 400 was additionally tested. Thus, each model furring strip 400, 500, 600, and the commercially available hat channel, were fixed to two studs spaced 24 inches (0.6096 m) apart. Each model furring strip was subjected to test loads of 35 lbf (155.7 N) and 44.4 lbf (195.7 N), at a single point centered on the furring strip and between the studs. For the 35 lbf test load, 6 D common nails were used at the load location; for the 44.4 lbf test load, no. 8 screws were used at the load location. Each model furring strip was then further tested with seven test loads of 35 lbf (155.7 N) spaced evenly between the studs at 4 inches (10.16 cm), again using 6 D common nails, and with three loads of 44.4 lbf (195.7 N) spaced evenly between the studs at 8 inches (20.32 cm), again using no. 8 screws. The maximum deformation was measured as presented below in Table 2.

TABLE 2

Results of wind load deformation tests of example furring strips 400, 500, 600 relative to commercially available furring without drainage.

| | 1 × 35 lbf Max. Deflection | 1 × 44.4 lbf Max. Deflection | 7 × 35 lbf Max. Deflection | 3 × 44.4 lbf Max. Deflection |
|---|---|---|---|---|
| Commercial Hat Channel | 0.019 inches (0.4826 mm) | 0.023 inches (0.5842 mm) | 0.058 inches (1.4732 mm) | 0.041 inches (1.041 mm) |
| Furring Strip 400 | 0.025 inches (0.635 mm) | 0.031 inches (0.7874 mm) | 0.072 inches (1.8288 mm) | 0.051 inches (1.2954 mm) |
| Strip 400, 20ga | 0.041 inches (1.041 mm) | 0.052 inches (1.3208 mm) | 0.110 inches (2.794 mm) | 0.083 inches (2.1082 mm) |
| Furring Strip 500 | 0.024 inches (0.6096 mm) | 0.030 inches (0.762 mm) | 0.068 inches (1.7272 mm) | 0.049 inches (1.2446 mm) |
| Furring Strip 600 | 0.021 inches (0.5334 mm) | 0.026 inches (0.6604 mm) | 0.063 inches (1.6002 mm) | 0.046 inches (1.1684 mm) |

Thus, as shown by the wind load deformation testing results above, various embodiments of the furring strips provided herein can provide substantially improved flexibility and/or customizability of cladding installation configurations, while maintaining satisfactory drainage and resistance to wind load deformation.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Although making and using various embodiments are discussed in detail below, it should be appreciated that the description provides many inventive concepts that may be embodied in a wide variety of contexts. The specific aspects and embodiments discussed herein are merely illustrative of ways to make and use the systems and methods disclosed herein and do not limit the scope of the disclosure. The systems and methods described herein may be used for mounting cladding articles to building substrates and are described herein with reference to this application. However, it will be appreciated that the disclosure is not limited to this particular field of use.

Some embodiments have been described in connection with the accompanying drawings. The figures are drawn to scale, but such scale should not be limiting, since dimensions and proportions other than what are shown are contemplated and are within the scope of the disclosed inventions. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

What is claimed is:

1. A wall cladding system having a multifunction structural furring, the wall cladding system comprising:

a metal furring strip, said furring strip comprising:

a substantially planar face defined generally by a length and a width, the face comprising a first edge and a second edge opposite the first edge along the width, the face comprising an array of integrally formed dimples with a spacing of at least 0.25 inches and not greater than approximately 1 inch between adjacent dimples, each dimple comprising a protrusion extending from an outer side of the face and a recess within an inner side of the face opposite the protrusion, at least a portion of each dimple of the face comprising a spherical segment;

a plurality of substantially planar webs, each web extending from the first edge or the second edge of the face in a direction opposite the outer side, each web comprising a plurality of openings extending through the web, the openings configured to allow water to flow through both webs; and a plurality of substantially planar legs parallel to the face, each leg extending from one of the plurality of webs at an end opposite the face, each leg comprising a row of integrally formed dimples, each dimple comprising a protrusion extending from an inner side of the leg opposite the webs and face and a recess within an outer side of the face opposite the protrusion, at least a portion of each dimple of the legs comprising a spherical segment;

wherein the furring strip is mounted to the exterior of a building substrate such that the convex dimples of the legs abut the building substrate and the length of the face is in a horizontal orientation relative to the building substrate; and at least one wall cladding panel mounted to the furring strip such that the convex dimples of the face abut the wall cladding panel;

wherein an inner surface of the wall cladding panel, the outer side of the face, and two or more of the dimples of the face define a first gravity-assisted drainage flow path; and wherein the building substrate, the inner sides of the legs, and two or more of the dimples of the legs define a second gravity-assisted drainage flow path.

2. The wall cladding system of claim 1, wherein the rolled sheet metal comprises steel having a thickness of at least 20 gauge and not greater than 16 gauge.

3. The wall cladding system of claim 1, wherein the dimples are arranged in a rectangular array on the face.

4. The wall cladding system of claim 1, wherein the dimples extend to a height of between approximately 0.03125 inches and approximately 0.25 inches relative to the outer side of the face.

5. The wall cladding system of claim 1, wherein a wind load producing a force of 44.4 lbf at two or more adjacent mechanical fasteners mounting the wall cladding panel to the furring strip induces a deflection in the face between 0 and l/240 inches, where l is the span distance, expressed in inches, between the two adjacent mechanical fasteners.

6. A furring strip for mounting a wall cladding article to a building substrate, the furring strip comprising:

a substantially planar face defined generally by a length and a width, the face comprising a first edge and a second edge opposite the first edge along the width;

a plurality of substantially planar webs, each web extending from the first edge or the second edge of the face; and a plurality of substantially planar legs parallel to the face, each leg extending from one of the plurality of webs at an end opposite the face;

wherein the face comprises a plurality of integrally formed dimples with a spacing of at least 0.25 inches and not greater than approximately 1 inch between adjacent dimples, each dimple comprising a protrusion extending from an outer side of the face and a recess within an inner side of the face opposite the protrusion configured to produce one or more drainage channels between the face and a cladding article secured to the face, at least a portion of each dimple comprising a spherical segment, said drainage channels defining at least one gravity-assisted fluid flow path when the furring strip is mounted in a horizontal or vertical orientation.

7. The furring strip of claim 6, wherein each of the plurality of legs comprises a plurality of protrusions configured to produce one or more drainage channels between the legs and a building substrate secured to the legs.

8. The furring strip of claim 6, wherein the protrusions comprise an array of dimples extending from an outer side of the face.

9. The furring strip of claim 8, wherein the dimples are arranged in a rectangular array on the face.

10. The furring strip of claim 8, wherein the dimples extend to a height of between approximately 0.03125 inches and approximately 0.25 inches relative to the outer side of the face.

11. The furring strip of claim 6, wherein each of the webs comprises a plurality of openings extending through the web to accommodate water or air flow through the web.

12. The furring strip of claim 11, wherein each of the openings has a width between approximately 0.1 inches and approximately 0.3 inches, and a length between approximately 0.5 inches and 1.5 inches.

13. The furring strip of claim 6, wherein the furring strip comprises rolled sheet steel having a thickness of at least 20 gauge and not greater than 16 gauge.

14. The furring strip of claim 6, wherein a wind load of approximately 44.4 lbf at two or more fastening points along the face produces a deflection between 0 and l/240 inches, where l is the span distance, expressed in inches, between the fastening points.

15. An adhesive drainage tape for a furring strip, the adhesive tape comprising:

a substantially planar tape defined generally by a length, a width, an inner surface, and an outer surface, the inner surface at least partially coated with a chemical adhesive; and an array of protrusions extending from the outer surface, the protrusions comprising substantially spherical domes generally defined by a height relative to the outer surface and a spacing of at least 0.25 inches and not greater than approximately 1 inch between adjacent protrusions;

wherein the adhesive tape is configured to be fixed by the chemical adhesive to a substantially flat face surface of a structural furring strip before an exterior cladding article is coupled to the furring strip such that, when the exterior cladding article is coupled to the furring strip, a gravity-assisted drainage flow path is defined by an inner surface of the wall cladding panel, the outer surface of the tape, and two or more of the protrusions.

16. The adhesive drainage tape of claim 15, wherein the protrusions are arranged in a rectangular array on the outer surface.

17. The adhesive drainage tape of claim 15, wherein the protrusions extend to a height of between approximately 0.03125 inches and approximately 0.25 inches relative to the outer surface.

18. The adhesive drainage tape of claim 15, wherein the protrusions extend to a height of between approximately 0.0625 inches and approximately 0.125 inches relative to the outer surface.

19. The adhesive drainage tape of claim 15, wherein the protrusions comprise dimples having a circular cross-section.

20. The adhesive drainage tape of claim 15, wherein the width of the adhesive tape is selected to fit against a face of a hat channel furring strip.

* * * * *